US007736290B2

(12) United States Patent
Oshiro et al.

(10) Patent No.: US 7,736,290 B2
(45) Date of Patent: Jun. 15, 2010

(54) SHEET FOLDING APPARATUS, SHEET FOLDING UNIT AND IMAGE FORMING APPARATUS

(75) Inventors: Toshiaki Oshiro, Izu (JP); Takahiro Kawaguchi, Mishima (JP); Tomomi Iijima, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 78 days.

(21) Appl. No.: 12/041,000

(22) Filed: Mar. 3, 2008

(65) Prior Publication Data

US 2008/0318753 A1 Dec. 25, 2008

Related U.S. Application Data

(60) Provisional application No. 60/944,972, filed on Jun. 19, 2007, provisional application No. 60/944,975, filed on Jun. 19, 2007, provisional application No. 60/944,978, filed on Jun. 19, 2007.

(30) Foreign Application Priority Data

Aug. 3, 2007 (JP) ..... 2007-202703
Sep. 26, 2007 (JP) ..... 2007-249672
Dec. 11, 2007 (JP) ..... 2007-319448

(51) Int. Cl.
*B31F 1/08* (2006.01)

(52) U.S. Cl. ..... 493/424; 493/425; 493/435; 493/427

(58) Field of Classification Search ..... 493/424, 493/425, 435, 426, 427, 429, 431
See application file for complete search history.

(56) References Cited

U.S. PATENT DOCUMENTS 5,169,376 A * 12/1992 Ries et al. ..... 493/445
6,276,677 B1 * 8/2001 Hommochi et al. ..... 270/32

(Continued)

FOREIGN PATENT DOCUMENTS

JP 11-193175 7/1999

(Continued)

*Primary Examiner*—Sameh H. Tawfik
(74) *Attorney, Agent, or Firm*—Turocy & Watson, LLP

(57) ABSTRACT

A sheet folding apparatus, including: a stacker configured to stack a plurality of sheets; a first folding roller configured to rotate around a first axis; a second folding roller configured to rotate around a second axis which is in parallel with the first axis and biased to the first folding roller separably to make a nip together with the first folding roller therebetween; a blade unit configured to push a surface of the plurality of sheets stacked by the stacker, into the nip; a first support configured to support the blade unit and configured to move linearly in a common tangential direction of the first folding roller and the second folding roller at the nip; and a second support configured to support the blade unit, configured to move linearly in the common tangential direction when the blade unit passes a section between where the blade unit starts touching at the plurality of sheets and where the plurality of sheets approaches the nip, and configured to deviate the blade away from the common tangential line to the second folding roller side with blocking deviating the blade unit away from the common tangential line to a first folding roller side when the plurality of sheets approaches the nip.

13 Claims, 30 Drawing Sheets

U.S. PATENT DOCUMENTS

| | | | | |
|---|---|---|---|---|
| 7,360,958 | B2 * | 4/2008 | Awano | 400/621 |
| 2008/0318752 | A1 * | 12/2008 | Oshiro et al. | 493/424 |

FOREIGN PATENT DOCUMENTS

| | | |
|---|---|---|
| JP | 2000-327209 | 11/2000 |
| JP | 2001-019269 | 1/2001 |
| JP | 2004-010198 | 1/2004 |

* cited by examiner

SHEET FOLDING APPARATUS, SHEET FOLDING UNIT AND IMAGE FORMING APPARATUS

CROSS-REFERENCE TO RELATED APPLICATIONS

This non-provisional application is based upon and claims the benefit of priority from: U.S. provisional application 60/944,972, filed on Jun. 19, 2007; U.S. provisional application 60/944,975, filed on Jun. 19, 2007; and U.S. provisional application 60/944,978, filed on Jun. 19, 2007, the entire contents of each of which are incorporated herein by reference.

This application is also based upon and claims the benefit of priority from Japanese Patent Application No. 2007-202703, filed on Aug. 3, 2007; Japanese Patent Application No. 2007-249672, filed on Sep. 26, 2007; and Japanese Patent Application No. 2007-319448, filed on Dec. 11, 2007, the entire contents of each of which are incorporated herein by reference.

TECHNICAL FIELD

Exemplary embodiments described herein relate to a sheet folding apparatus and a sheet finishing system.

BACKGROUND

JP-11-193175-A2, corresponding to U.S. Pat. No. 688,677, and JP-2001-19269-A2 describe various sheet post-processing apparatuses which process stapling, punching, and folding of sheets.

In particular, a sheet bundle folding apparatus with movable push-in member described in both JP-11-193175-A2 and U.S. Pat. No. 688,677 includes a stick-out plate which follows a position of a fold on a sheet bundle when a pair of folding rollers holds the sheet bundle. The sheet bundle folding apparatus includes the pair of folding rollers, the stick-out plate, a pair of sliding-rollers, a groove, and a spring. The pair of sliding-rollers slides in the groove. The pair of sliding rollers is attached on the stick-out plate to support the stick-out plate. A diameter of one of the pair of sliding-rollers is smaller than a width of the groove.

A shaft of one of the sliding-rollers is pulled across the longitudinal direction of the groove by the spring connected with a chassis of the sheet bundle folding apparatus. The pair of sliding-rollers follows the stick-out plate advancing and pulling out. A pivot of a first end of the spring is stationary on the chassis, and a second end of the spring follows one of the pair of sliding-rollers. Therefore, the spring varies its posture (e.g., tilt angle from a direction perpendicular to a direction where the stick-out plate advances along) according to a position of the stick-out plate. The pivot causes an abrasion on both ends of the spring which is shaped as a hook or a ring. To avoid the abrasion, a bearing structure may be employed for the pivot. However the bearing structure is expensive.

Additionally, the tilt angle of the spring causes a reduction of an elemental force across the longitudinal direction of the groove. As a result, the stick-out plate changes position to push sheets to create fold on the sheets each time, and a fold on a sheet bundle changes each time. To avoid the abrasion, a strong spring may be employed. However the strong spring causes an undesirable side effect; namely, increasing a resistance force against advancing the stick-out plate along the longitudinal direction of the groove can result.

On the other hand, a recording paper after-treatment device for a picture image formation device described in JP-2001-19269-A2 includes a post processing tray for supporting a sheet bundle including sheets provided from the picture image formation device, a central folding roller pair for making a nip therebetween, and a central folding plate for pushing the sheet bundle into the nip to fold the sheet bundle.

The post processing tray bends to the nip to guide the sheet bundles smoothly. An upper one of the central folding roller pair is pushed upwards by the other folding roller in the pair and the sheet bundle by a thickness of the sheet bundle. However, the post processing tray does not move. That is, the nip varies its relative position against the post processing tray. Therefore, a fold on the sheet bundle varies its position according to its thickness. Moreover, the pressure for the sheet bundle by the central folding roller pair varies according to the thickness to make wrinkles.

SUMMARY

The following presents a simplified summary in order to provide a basic understanding of one or more aspects of the invention. This summary is not an extensive overview of the invention. It is not intended to identify key or critical elements, nor to delineate the scope of the claimed subject matter. Rather, the sole purpose of this summary is to present some concepts of the invention in a simplified form as a prelude to the more detailed description that is presented hereinafter.

According to an exemplary embodiment, one aspect of the invention is a sheet folding apparatus, including: a stacker configured to stack a plurality of sheets; a first folding roller configured to rotate around a first axis; a second folding roller configured to rotate around a second axis which is in parallel with the first axis and biased to the first folding roller separably to make a nip together with the first folding roller therebetween; a blade unit configured to push a surface of the plurality of sheets stacked by the stacker, into the nip; a first support configured to support the blade unit and configured to move linearly in a common tangential direction of the first folding roller and the second folding roller at the nip; and a second support configured to support the blade unit, configured to move linearly in the common tangential direction when the blade unit passes a section between where the blade unit starts touching at the plurality of sheets and where the plurality of sheets approaches the nip, and configured to deviate the blade away from the common tangential line to the second folding roller side with blocking deviating the blade unit away from the common tangential line to a first folding roller side when the plurality of sheets approaches the nip.

Another aspect of the invention relates to a sheet folding unit, including: a first folding roller configured to rotate around a first axis; a second folding roller configured to rotate around a second axis which is in parallel with the first axis and biased to the first folding roller separably to make a nip together with the first folding roller therebetween; a blade configured to push a surface of a sheet into the nip; a first support configured to support the blade and configured to move linearly in a common tangential direction of the first folding roller and the second folding roller at the nip; and a second support configured to support the blade, configured to move linearly in the common tangential direction when the blade passes a section between where the blade starts touching at the surface of the sheet and where the sheet approaches the nip, and configured to deviate the blade away from the common tangential line to the second folding roller side with blocking deviating the blade away from the common tangential line to a first folding roller side when the sheet approaches the nip.

Yet another aspect of the invention relates to an image forming apparatus, including: a image forming unit configured to form images on a plurality of sheets; a stacker configured to stack the plurality of sheets; a first folding roller configured to rotate around a first axis; a second folding roller configured to rotate around a second axis which is in parallel with the first axis and biased to the first folding roller separably to make a nip together with the first folding roller therebetween; a blade unit configured to push a surface of at least one sheet of the plurality of sheets stacked by the stacker, into the nip; a first support configured to support the blade unit and configured to move linearly in a common tangential direction of the first folding roller and the second folding roller at the nip; and a second support configured to support the blade unit, configured to move linearly in the common tangential direction when the blade unit passes a section between where the blade unit starts touching at the plurality of sheets and where the plurality of sheets approaches the nip, and configured to deviate the blade unit away from the common tangential line to the second folding roller side with blocking deviating the blade unit away from the common tangential line to the first folding roller side when the plurality of sheets approaches the nip.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention may be employed. Other aspects, advantages and novel features of the invention will become apparent from the following description when considered in conjunction with the drawings.

BRIEF DESCRIPTION OF THE SEVERAL VIEWS OF THE DRAWINGS

The invention and attendant advantages therefore are best understood from the following description of the non-limiting embodiments when read in connection with the accompanying Figures, wherein.

DETAILED DESCRIPTION

Figure 1:
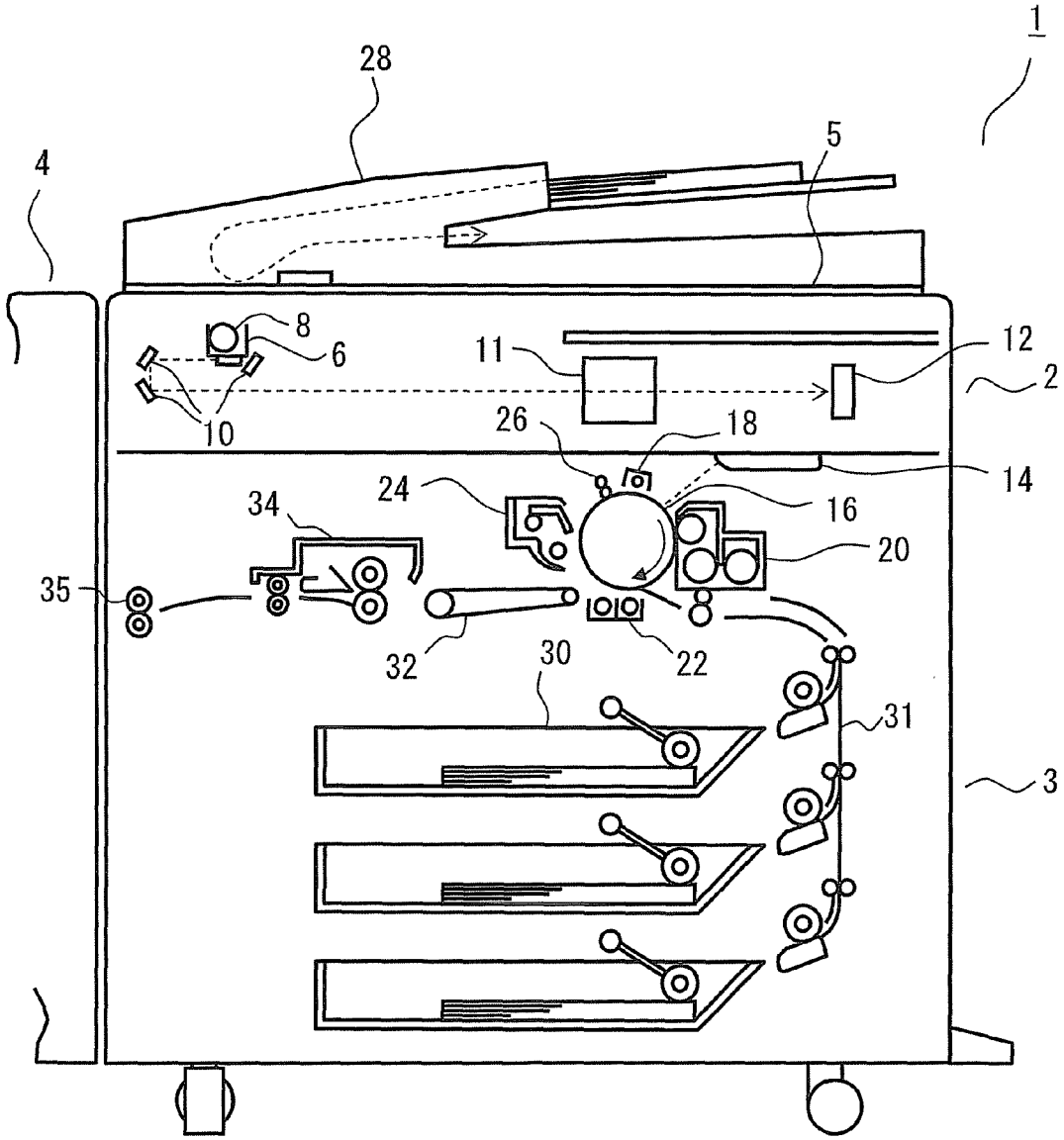
FIG. 1 is a diagram illustrating an exemplary cross-sectional view of an image forming apparatus.

Referring now to the Figures in which like reference numerals designate identical or corresponding parts throughout the several views.

FIG. 1 illustrates an exemplary cross-sectional view of an image forming apparatus. The image forming apparatus 1 includes a scanner unit 2 and a printer unit 3. The image forming apparatus 1 may connect with a sheet finishing apparatus 4. The scanner unit 2 can scan a reference to obtain image data. The printer unit 3 receives the image data and prints an image corresponding with the image data. The scanner unit 2 includes a scanning bed 5, a carriage 6, a lamp 8, one or more mirrors 10, a lens 11, and a CCD (Charge Coupled Device) 12. The scanner unit 2 may also include an ADF (Automatic Document Feeder) 28. The printer unit 3 includes a photo detector 16, a laser unit 14, a charger 18, a developer 20, a transfer unit 22, a cleaner 24, a discharger lamp 26, a sheet feeder 30, a sheet supply path 31, a conveyer 32, a fixing unit 34, and a discharge roller pair 35. The reference is laid, or may be swept by the ADF 28, on the scanning bed 5. The scanning bed 5 is transparent for light of the lamp 8. The carriage 6 supports the lamp 8 to sweep the light on the reference through the scanning bed 5. The one or more mirrors 10 conduct the light reflected by the reference laid on the scanning bed 5. The lens 11 focus the light on the CCD 12. The CCD 12 converts the light to an analog signal. The laser unit 14, the charger 18, the developer 20, the transfer unit 22, the cleaner 24, and the discharger lamp 26 are set around the photo detector 16. The charger 18 charges a surface of the photo detector 16 uniformly along a rotation axis of the photo detector 16. The laser unit 14 sweeps a laser that is switched on and off (e.g., blinking) in accordance with the analog signal to form a latent image on the surface of the photo detector 16. The developer 20 provides a development material such as a toner on the latent image. The toner develops the latent image to a toner image. The transfer unit 22 transfers the toner image to a sheet conveyed through the sheet supply path 31 from the sheet feeder 30. The fixing unit 34 fixes the toner image placed on the sheet conveyed by the conveyer 32. The discharge roller pair 35 discharges the sheet from the printer unit 3 and feeds the sheet to the sheet finishing apparatus 4. The cleaner 24 removes residual toner, if present, on the photo detector 16. The discharger lamp 26 discharges the surface of the photo detector 16.

Exemplary embodiments of the sheet finishing apparatus 4 are described below in FIG. 2 and FIG. 3. The sheet finishing apparatus 4 receives the sheet handed off by the discharge roller pair 35 of the image forming apparatus 1, and processes the sheet. The sheet finishing apparatus 4 can at least one of sort, staple, center fold, and/or saddle-stitch the sheet according to an operation that an operator inputs from a control panel and/or a computer.

Figure 2:
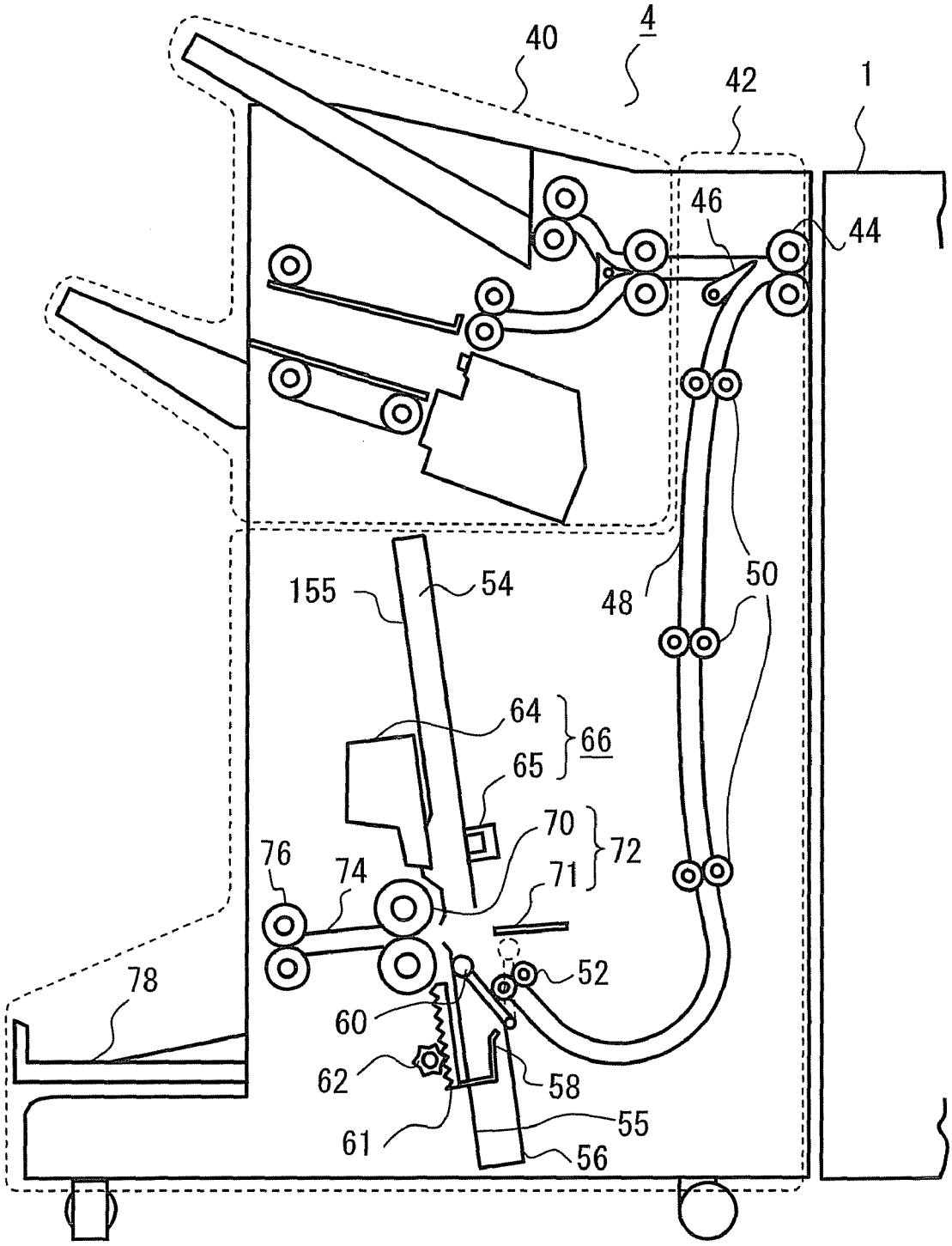
FIG. 2 is a diagram illustrating a first exemplary embodiment of a sheet finishing apparatus.

FIG. 2 illustrates a first exemplary embodiment of the sheet finishing apparatus 4. The sheet finishing apparatus 4 includes a finishing unit 40 and a saddle unit 42. The finishing unit 40 performs the sorting and the stapling. Well known ordinary structures such as disclosed in JP-2007-76862-A2 and other references may be employed as the finishing unit 40, and JP-2007-76862-A2 is incorporated by reference in this regard. The saddle unit 42 can include an inlet roller pair 44, a path switch 46, a first path 48, a second path 54, one or more intermediate transfer roller pairs 50, an injection roller pair 52, a lower wall panel 55, an upper wall panel 155, a ceiling plate 56, a stacker 58, an assist roller 60, a rack gear 61, a pinion gear 62, a stapler 66 including a stapler head 64 and an anvil 65, a sheet folding unit 72 including a folding roller pair 70 and a blade 71, a connecting corridor 74, an outlet roller pair 76, and a sheet tray 78.

The inlet roller pair 44 receives the sheet discharged by the discharge roller pair 35 of the image forming apparatus 1. The path switch 46 turns to a position to direct the sheet to the first path 48 when center folding is desired and/or saddle-stitching is desired for the sheet; otherwise, the path switch 46 takes the other position to direct the sheet to the finishing unit 40. The first path 48 extends below and curves to upward direction at an end. The intermediate transfer roller pair(s) 50 conveys the sheet along the first path 48 and hands off the sheet to the injection roller pair 52. The injection roller pair 52 injects the sheet to the second path 54 in the upward direction to let the sheet after clime up the second path 54. The second path 54 is sandwiched by the lower wall panel 55 and the ceiling plate 56 at a lower region, and is sandwiched by the upper wall panel 155 and the ceiling plate 56 at an upper region. The lower wall panel 55 and the upper wall panel 155 tilt from vertical. The ceiling 56 is above the lower wall panel 55 and the upper wall panel 155 and the ceiling 56 is in parallel with the lower wall panel 55 and the upper wall panel 155.

The stacker 58 receives the sheet which slides down the second path 54 to the lower wall panel 55 and the upper wall panel 155 after climbing up the second path 54. An action switching a moving direction of the sheet from climbing up to sliding down is so called "switch back". The sheet takes a standing position with supports from the stacker 58 and the lower wall panel 55. The stacker 58 connects to the rack gear 61 and the rack gear 61 engages with the pinion gear 62. The pinion gear 62 rotates to drive the stacker 58 upward and downward. The stacker 58 further moves to a position to center the sheet to be stapled with the stapler 66 and to be folded with the sheet folding unit 72. The stacker 58 positions the center of the sheet in front of the stapler 66 in case of saddle-stitching. The assist roller 60 retracts from an orbit of the sheet to a position illustrated with a broken line when the injection roller pair 52 injects the sheet. After the injection roller pair 52 injects the sheet, the assist roller 60 takes the other position illustrated with a solid line for contacting the sheet to assist sliding down of the sheet, and for aligning the lower end of the sheet on the stacker 58. After alignment is finished, the assist roller 60 takes the position to retract again and the stacker 58 waits for the next sheet to be received. The stapler 66 staples the center of the sheets stacked on the stacker 58 by advancing the stapler head 64 to the anvil 65. The stacker 58 descends to position the center of the sheets in front of the blade 71 of the sheet folding unit 72, which is lower than the stapler 66. The blade 71 retracts behind the ceiling plate 56 from the second path 54 to avoid interfering with the sheet sliding down. The blade 71 advances to push the center of the sheets into a nip of the folding roller pair 70 after the sheets are set by the stacker 58. The folding roller pair 70 pinches the sheets and conveys the sheets with a folded edge of the sheets in the lead. The folding roller pair 70 hands off the sheets to the outlet roller pair 76 through the connecting corridor 74, and the outlet roller pair 76 ejects the sheets on the sheet tray 78.

Figure 3:
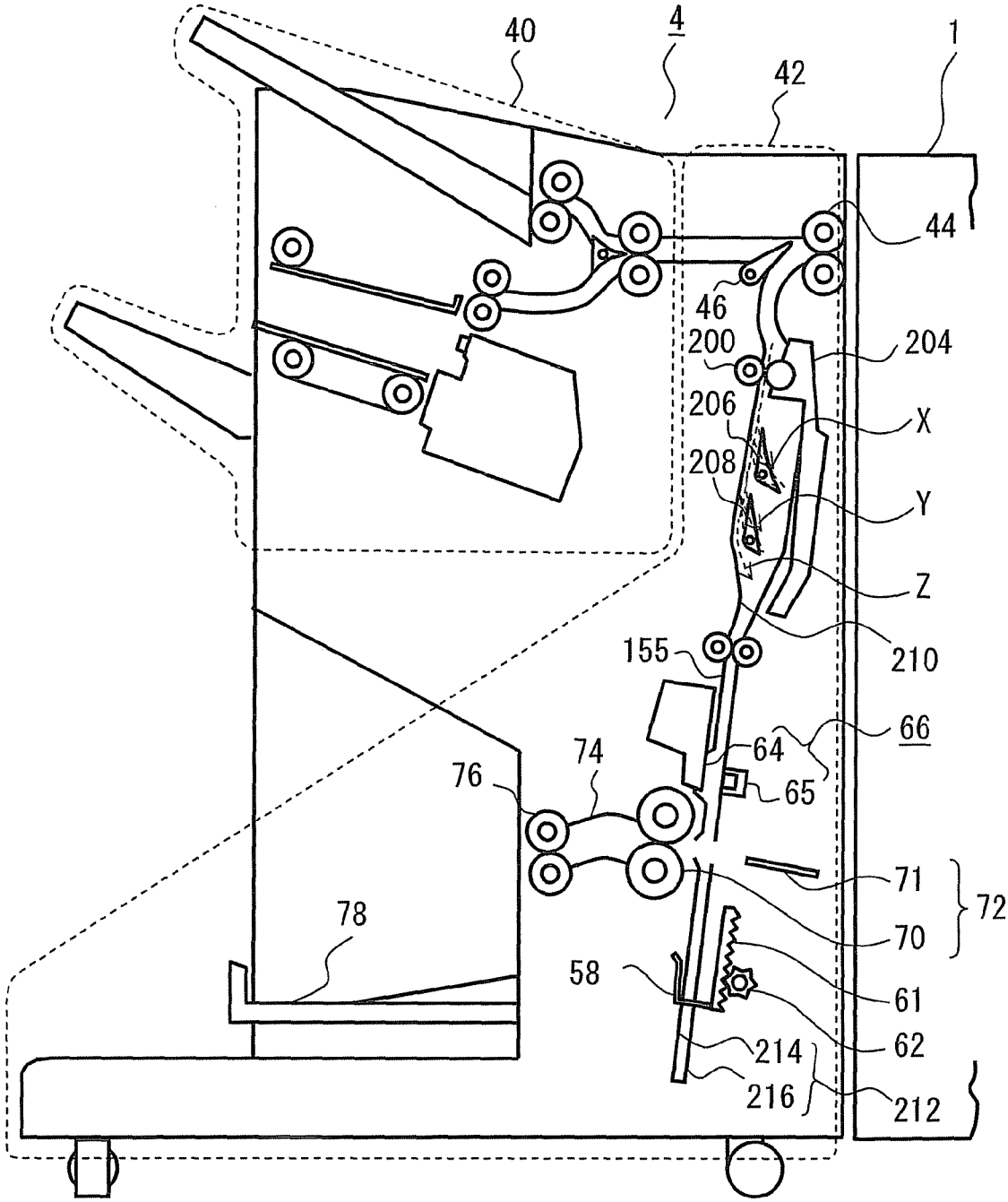
FIG. 3 is a diagram illustrating a second exemplary embodiment of a sheet finishing apparatus.

FIG. 3 illustrates a second exemplary embodiment of the sheet finishing apparatus 4. Well known ordinary structures such as disclosed in JP-2007-76862-A2 and other references may be employed as the finishing unit 40. The saddle unit 42 includes an inlet roller pair 44, path switches 46, 206 and 208, an intermediate transfer roller pair 200, a holder 204, a guide wall 210, a path 212 configured with an wall panel 214 and a guide panel 216, a stapler including a stapler head 64 and an anvil 65, a sheet folding unit 72 including a folding roller pair 70 and a blade 71, a stacker 58, and a sheet tray 78.

The inlet roller pair 44 receives the sheet handed off by the discharge roller pair 35 of the image forming apparatus 1. The path switch 46 turns to a position to conduct the sheet to the intermediate transfer roller pair 200 when center folding and saddle-stitching the sheet; otherwise, the path switch 46 takes the other position to conduct the sheet to the finishing unit 40. The path switches 206 and 208 conduct the sheet to the path 212 according to a size of the sheet. For example, the path switch 206 may turn to a position to deflect the sheet proceeding along the guide wall 210 to the path 212 for an A3 sized sheet indicated with a broken line Z. The path switch 206 may be set at a position not to deflect the sheet and the path switch 208 may turn to a position to deflect the sheet proceeding along the guide wall 210 to the path 212 for a B4 sized sheet indicated with a broken line Y. Neither path switches 206 nor 208 may be set at a position to deflect the sheet to proceed to the path 212 along the guide wall 210 for an A4 sized sheet indicated with a broken line X. The path 212 may be substantially straight and/or substantially vertical. Further, the path 212 can be configured with the wall panel 214 and the guide panel 216 under the holder 204.

The stacker 58 receives a lower end of the sheet sliding down in the path 212. The stacker 58 may wait to receive the sheet at a position where a center of a face of the sheet meets the stapler head 64 and the anvil 65 for stapling the sheet. An upper end of the sheet is kept higher than a position where a lower end of the following sheet is estimated to contact the holder 204. The position of the stacker 58 varies according to which one of the path switches 206 and 208, or none of the path switches 206 and 208, deflect the sheet. That is to avoid the following sheet from encroaching the back side of the sheet, which is the side between the sheet and the guide panel 216 or is the side facing to other sheets supported together with the sheet by the stacker 58. The stacker 58 connects to the rack gear 61, wherein the rack gear 61 engages with the pinion gear 62. The pinion gear 62 rotates to drive the stacker 58 upward and downward. The stacker 58 moves to position a center of the sheet to be stapled with the stapler head 64 and the anvil 65, and to be folded with the sheet folding unit 72. The stacker 58 positions the center of the sheet between the stapler head 64 and the anvil 65 in case of saddle-stitching. The stapler head 64 staples the center of the sheets stacked on the stacker 58 by advancing to the anvil 65. The stacker 58 descends to position the center of the sheets in front of the blade 71 of the sheet folding unit 72, which is lower than the stapler head 64 and the anvil 65. The blade 71 retracts behind the guide panel 216 from the path 212 to avoid interfering with sliding down of the sheet. The blade 71 advances to push the center of the sheets into a nip of the folding roller pair 70 after the sheets are set by the stacker 58. The folding roller pair 70 pinches the sheets and conveys the sheets with a folded edge of the sheets in the lead. The folding roller pair 70 hands off the sheets to the outlet roller pair 76 through the connecting corridor 74, and the outlet roller pair 76 ejects the sheets on the sheet tray 78.

The exemplary structures, and other modifications as well, may be employed as the sheet finishing apparatus 4. Furthermore, the saddle unit 42 may have contrivances around the sheet folding unit 72 such as instances described below.

(1) Instance 1 of Sheet Folding Unit

Figure 4:
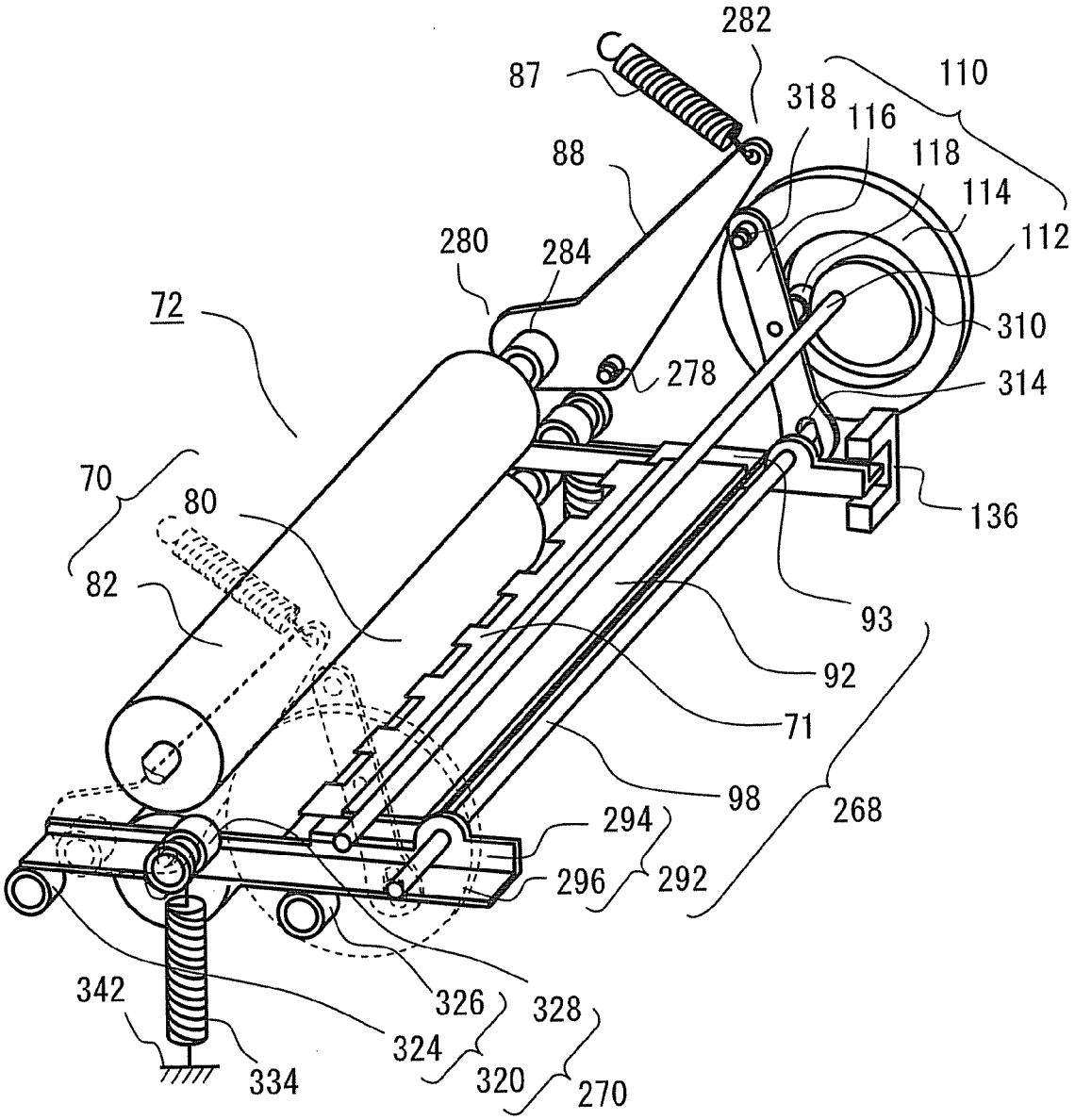
FIG. 4 is a diagram illustrating a perspective view of a first exemplary instance of a sheet folding unit.

FIG. 4 illustrates a perspective view of a first exemplary instance of the sheet folding unit 72.

The sheet folding unit 72 includes the folding roller pair 70, a pair of springs 87, a pair of levers 88, a blade unit 268, a blade driving structure 110, a pair of guide frame supports 270 and a position sensor 136. First ones of each of the pairs of components (e.g., the folding roller pair 70, the pair of springs 87, the pair of levers 88, and the pair of guide frame supports 270) except for the folding roller pair 70 are positioned on a first end side of the folding roller pair 70, and second ones of the pairs of components are positioned on a second end side of the folding roller pair 70.

The folding roller pair 70 includes a lower folding roller 80 and an upper folding roller 82 in parallel with each other. The lever 88 rotates around a fulcrum 278 which is relatively stationary with respect to an axis around which the lower folding roller 80 rotates. The fulcrum 278 and the axis may be stationary with a structure frame of the sheet finishing apparatus 4. An end of the spring 87 may be stationary together with the fulcrum 278 and the axis, as well. A first end of the lever 88 includes an opening or a hole 284 to support an axis around which the upper folding roller 82 rotates. The spring 87 pulls a second end 282 of the lever 88 to depress the upper folding roller 82 against the lower folding roller 80 to make a nip therebetween based on leverage theory. The upper folding roller 82 can be pushed almost linearly away from the lower folding roller 80. The lower folding roller 80 may be driven by a motor, and the upper folding roller 82 may follow the lower folding roller 82.

The blade unit 268 includes the blade 71, a first blade holder 92, a second blade holder 93, a pair of guide frames 292 and a blade shaft 98. The blade unit 268 is driven by the blade driving structure 110. The pair of guide frames 292 is mutually symmetric, and support respective ends of the second blade holder 93. The first blade holder 92 and the second blade holder 93 clip the blade 71 therebetween. The guide frame 292 includes a side plate 294 and a rib 296. The rib 296 connects with the side plate 294 perpendicularly to form an "L" shape, and can be slidably supported by the guide frame support 270. The side plate 294 is supported by the blade shaft 98. Both ends of the blade shaft 98 connect to the blade driving structure 110.

The blade driving structure 110 includes a cam shaft 112, a pair of cam race wheels 310, a pair of cam arms 116 and a pair of skids 118. To drive both ends of the blade shaft 98 respectively, the first ones of the pairs of components are positioned on a first end side of the cam shaft 112, and the second ones of the pairs of the components are positioned on a second end side of the cam shaft 112 symmetrically. The cam shaft 112 has its axis relatively stationary with respect to the axis around which the lower folding roller 80 rotates. The cam shaft 112 is driven around its axis by a power source. The cam race wheel 114 rotates along with the cam shaft 112, and includes a groove 310 in which the skid 118 moves. The skid 118 rotates along the groove 310, and supports a midpoint of the cam arm 116. The cam arm 116 includes a fulcrum 318 that rotates around a first end which is illustrated as an upper side in FIG. 4. The fulcrum 318 is relatively stationary with respect to the axis around which the cam shaft 112 rotates. When the cam shaft 112 is driven, the cam race wheel 114 rotates to move the skid 118, and the cam arm 116 swings a second end around the fulcrum 318 on the first end. The second end of the cam arm 116 includes an opening such as an oval hole 314 to support the blade shaft 98. The position sensor 136, which can be a photoelectric sensor for example, detects whether or not the blade 71 is at the evacuating position to control the drive on the cam shaft 112.

The guide frame support 270 includes stationary skids 320, which collectively include a front stationary skid 324 and a rear stationary skid 326, and a movable skid 328. The stationary skids 320 are relatively stationary with respect to the axis around which the lower folding roller 80 rotates. Axes of the stationary skids 320 are aligned in a direction parallel with a direction of a common tangential line to the upper folding roller 82 and the lower folding roller 80 at the nip. The movable skid 328 moves across a direction along a straight line between the stationary skids 320, but is biased to go on the straight line by a first end 336 of a spring 334. A second end 338 of the spring 334 is held relatively stationary with respect to the axis around which the lower folding roller 80 rotates. The blade 71 advances from the rear stationary skid 326 side to the front stationary skid 324 side to push a sheet into a nip of the folding roller pair 70. The stationary skids 320 can support an under surface of the rib 296 slidably along the straight line. The movable skid 328 pushes an upper surface of the rib 296 to keep the rib 296 between itself and the stationary skids 320. Therefore, the guide frames 292 moves linearly, and the blade 71 moves linearly along with the guide frame 292. Moreover, the oval hole 314 on the second end of the cam arm 116 allows the linear movement of the guide frame 292 because the oval hole 314 allows relative bobbing of the blade shaft 98. It is contemplated that the stationary skids 320 and the movable skid 328 may be replaced by a non-rotating static structure if there are enough lubricity and resistance against an abrasion.

Figure 5:
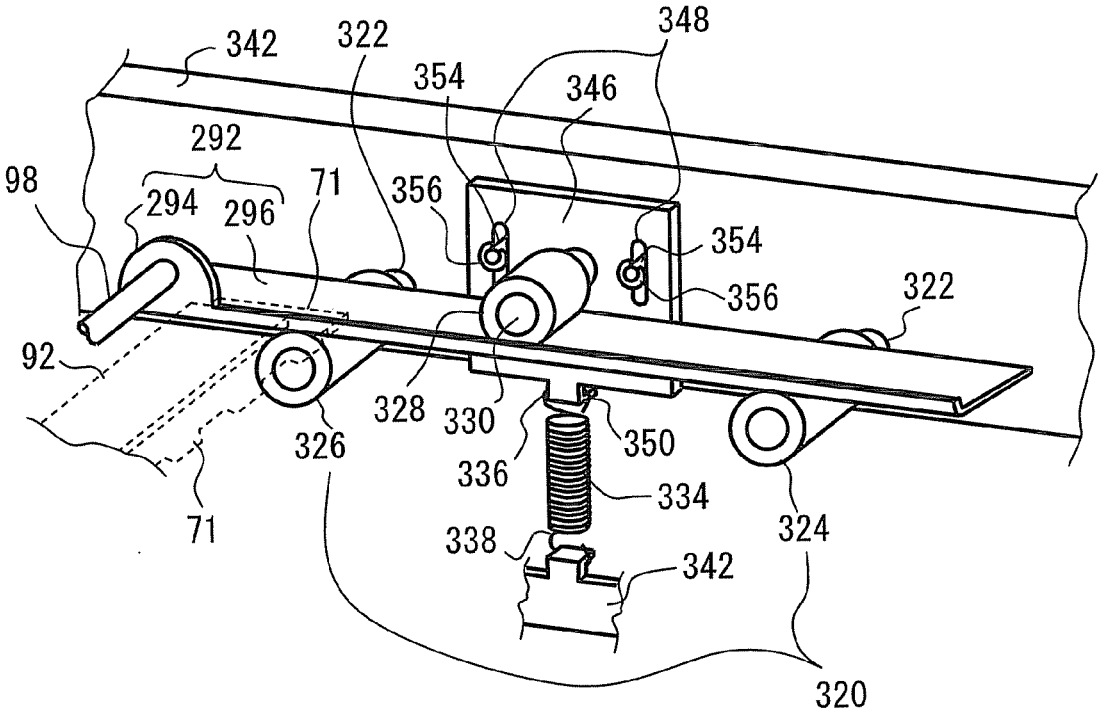
FIG. 5 is a diagram illustrating a perspective view around a guide frame of a first exemplary instance of a sheet folding unit.

FIG. 5 illustrates a perspective view around the guide frame 292. A pair of stationary skid shafts 322 around which the front stationary skid 324 and the rear stationary skid 326 rotate are stationary with respect to a frame 342 which is fixed to the structural frame of the sheet finishing apparatus 4. A shaft 330 is fixed on a movable plate 346. The movable skid 328 rotates around the shaft 330. The movable plate 346 includes two oval holes 348, wherein such oval holes 348 have vertical major axes perpendicular to the straight line between the stationary skids 320, respectively. Two shafts 354 respectively traverse through the oval holes 348 to support the movable plate 346 movably along the major axes of the oval holes 348. The frame 342 supports first ends of the shafts 354. E rings 356 fit second ends of the shafts 354 and allow the movable plate 346 to slide. The movable plate 346 includes a hook 350 at its lower end to hook the first end 336 of the spring 334. The second end 338 of the spring 334 is connected on the frame 342. Therefore, the movable skid 328 is biased downwards together with the movable plate 346. A biasing direction of the spring 334 is preferably vertical, but may tilt off the vertical. The hook 350 may be located on any other region (e.g., the upper side) of the movable plate 346. According to another example, the movable skid 328 may be attached to the frame 342 directly instead of the movable plate 346; pursuant to this example, the movable skid 328 is slidable against the frame 342.

Figure 6:
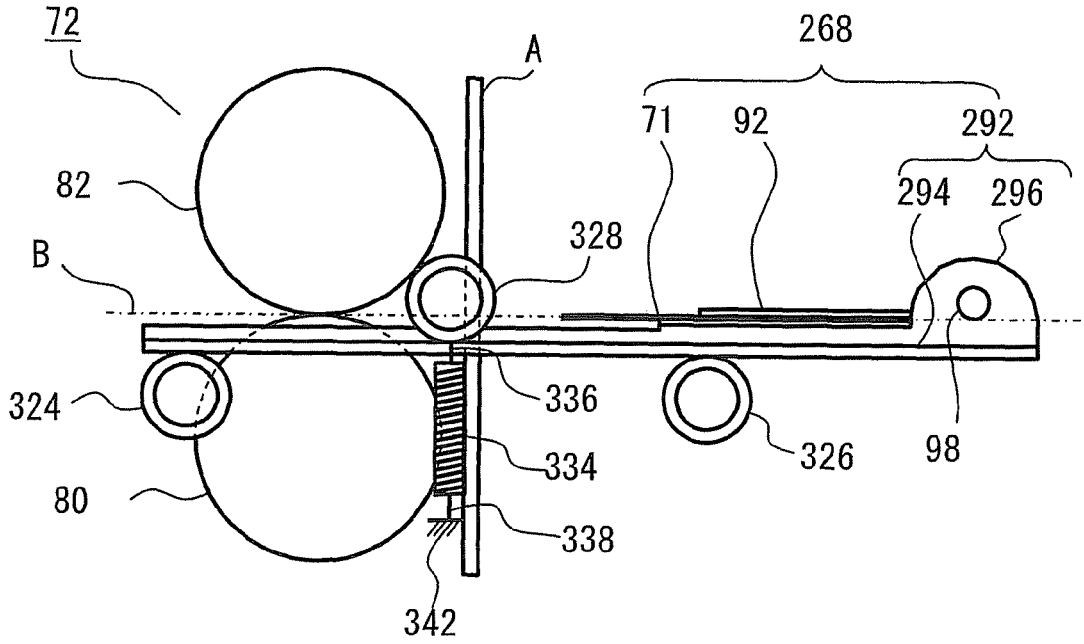
FIG. 6 is a diagram illustrating a cross sectional view of a first exemplary instance of a sheet folding unit before a blade contacts a sheet stack.
Figure 7:
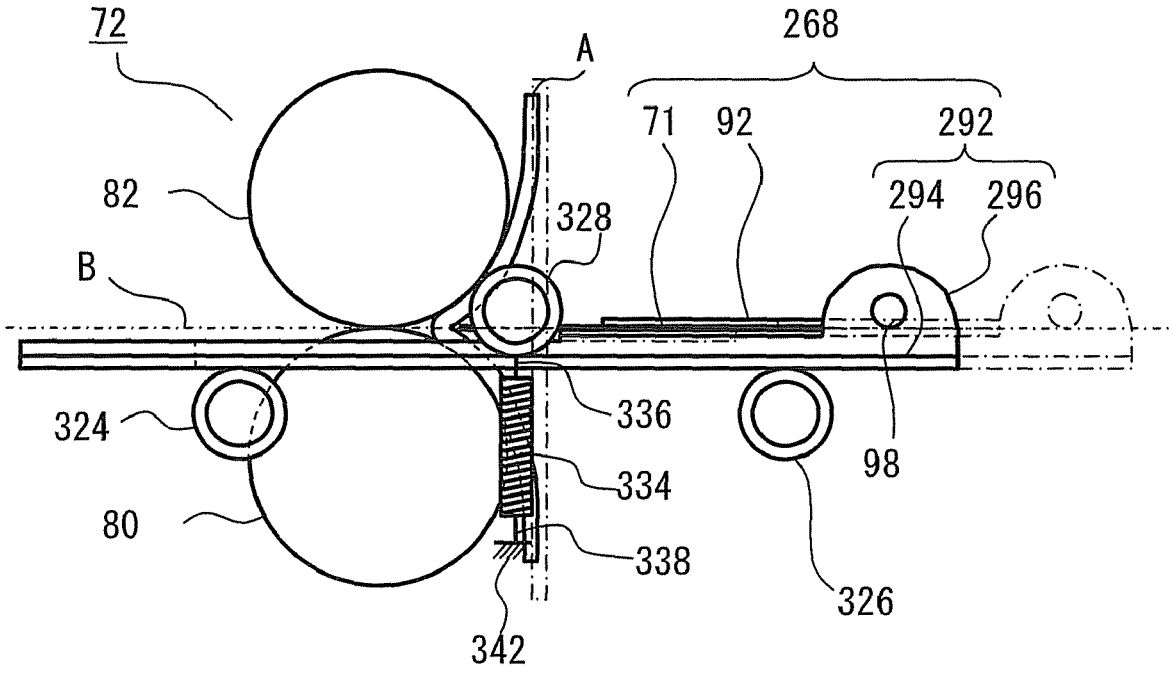
FIG. 7 is a diagram illustrating a cross sectional view of a first exemplary instance of a sheet folding unit before a blade approaches into a nip between a folding roller pair.
Figure 8:
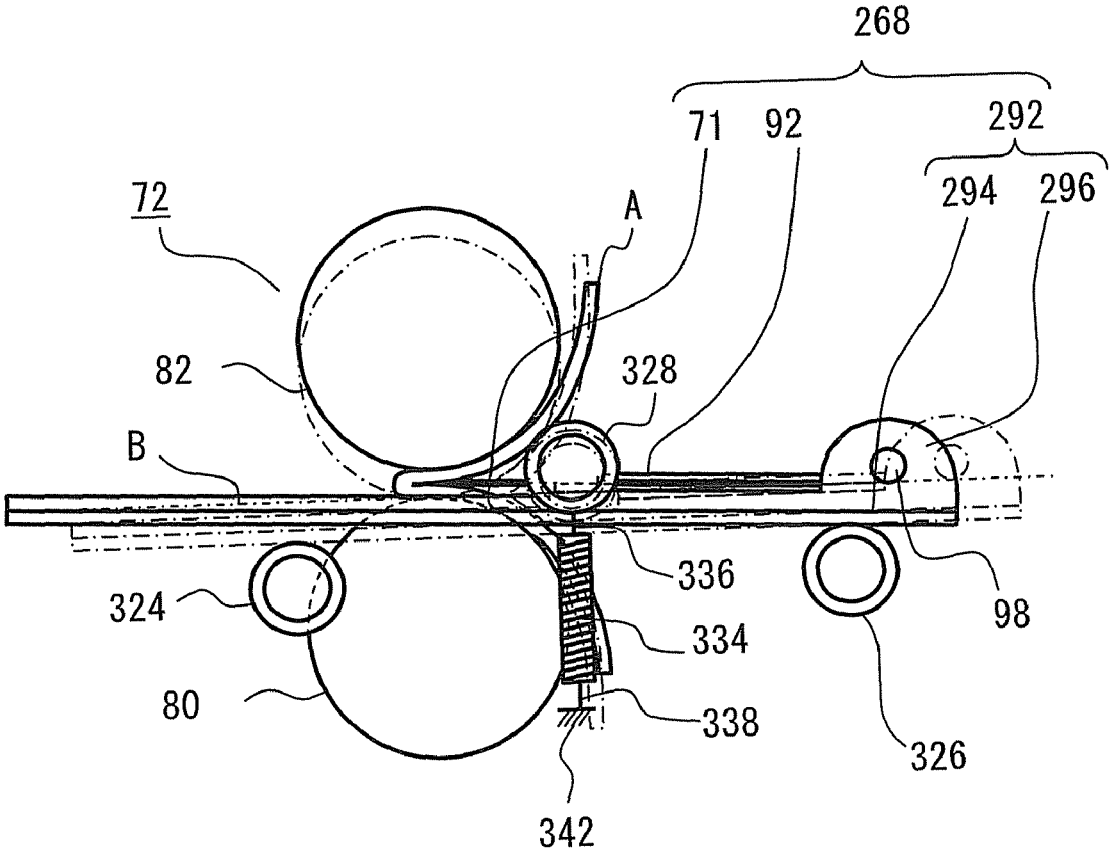
FIG. 8 is a diagram illustrating a cross sectional view of a first exemplary instance of a sheet folding unit after a folding roller pair nips a sheet stack.

An exemplary operation of the sheet folding unit is explained in FIG. 6 through FIG. 8, which illustrate cross sectional views of the sheet folding unit 72.

FIG. 6 illustrates a cross sectional view of the sheet folding unit 72 before the blade 71 contacts the sheet stack A. A dashed line B is a common tangential line to the lower folding roller 80 and the upper folding roller 82 at their nip. A center of the face of the sheet stack A faces a tip of the blade 71. The blade 71 is set along the line B to push an accurate position on the sheet stack A, and waits at an evacuating position to avoid interfering with sliding down of the sheet stack A. The position sensor 136 may confirm that the blade 71 is at the evacuating position. The stationary skids 320 and the movable skid 328 pinch the blade unit 268 to provide slidable support along the line B. After the center of the sheet stack A is aligned on the line B by the stacker 58, the blade unit 268 advances linearly to contact the blade 71 to the center of the sheet stack A along the line B.

FIG. 7 illustrates a cross sectional view of the sheet folding unit 72 before the blade 71 approaches into the nip between the folding roller pair 70. After the blade 71 contacts the center of the sheet stack A, the blade unit 268 advances further along the line B to let the folding roller pair 70 nip the sheet stack A.

FIG. 8 illustrates a cross sectional view of the sheet folding unit 72 after the folding roller pair 70 nips the sheet stack A. The nip of the folding roller pair 70 is pushed up by about twice of the thickness of the sheet stack A at the upper folding roller 82 side only, because the lower folding roller 80 does not move against the stationary skids 320. Therefore, the tip of the blade 71 is pushed up by the sheet stack A on the lower folding roller 80. The movable skid 328 allows the guide frame 292 to pivot around a contact point with the rear stationary skid 326, as well as the blade 71 to deviate from the line B, by moving upward against the bias of the spring 334. This enables the tip of the blade 71 to be advanced together with the center of the sheet stack A. After the folding roller pair 70 nips the sheet stack A, the blade driving structure 110 backs the blade unit 268 off from the nip to position the blade 71 at the evacuating position to fold the next sheet stack. The folding roller pair 72 can then discharge the sheet stack A onto the sheet tray 78.

It is preferable for the blade 71 to advance along the line B until the folding roller pair 70 nips the sheet stack A, and for the movable skid 328 to be set in a section between the nip and a position where the blade 71 first contacts the sheet stack A According to the above embodiment, the movable skid 328 is biased by the spring 334 but the movable skid 328 does not move together with the blade unit 268.

Therefore, the spring 334 can tilt by a smaller angle than in a configuration where a spring pulls a skid attached on the folding unit 268.

The movable skid 328 may be configured to move along an extension direction of the spring 334 because such configuration makes the spring 334 not tilt at all. Such configuration reduces an abrasion of a pivot of the spring 334, and a scatter of an elemental force of the spring 334 to bias the movable skid 328.

(2) Instance 2 of Sheet Folding Unit

Figure 9:
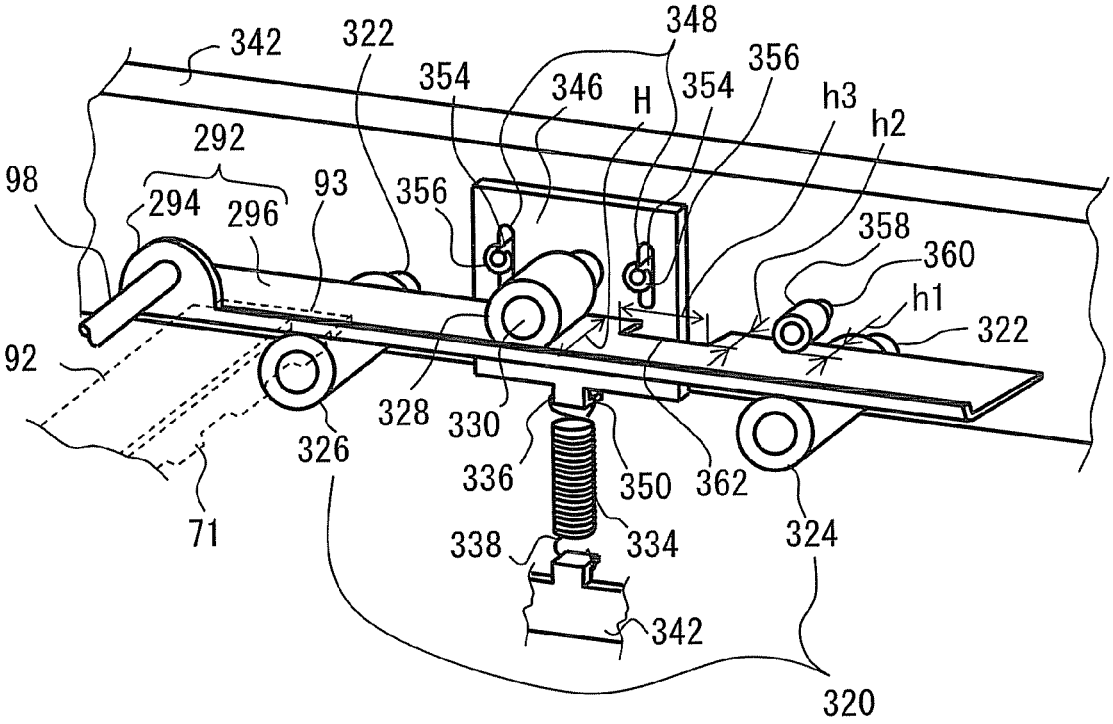
FIG. 9 is a diagram illustrating a perspective view around a guide frame of a second exemplary instance of a sheet folding unit.

FIG. 9 illustrates a perspective view of a second exemplary instance around the guide frame 292 of the sheet folding unit 72. In this instance, the frame 342 supports a regulation skid 358 positioned around a regulation skid shaft 360. The regulation skid shaft 360 is relatively stationary with respect to the pair of the stationary skid shafts 322. The regulation skid 358 contacts with, or may be close to without regularly contacting, an upper surface of the rib 296. The rib 296 slides between the regulation skid 358 and the stationary skids 320 without staggering, where staggering is up and down movement perpendicular to a direction where the guide frame 292 proceeds along. The regulation skid 358 has a narrower tread width h1 to contact with the rib 296 than the tread width H of the movable skid 328. The rib 296 includes at least one slot 362. A width h2 of the slot 362 perpendicular to a direction along which the guide frame 292 slides is equal to or wider than the tread width h1 of the regulation skid 358, and may be narrower than the tread width H of the movable skid 328. Moreover, a length h3 of the slot 362 in parallel with a direction along which the guide frame 292 slides may be longer than a diameter of the regulation skid 358.

Figure 10:
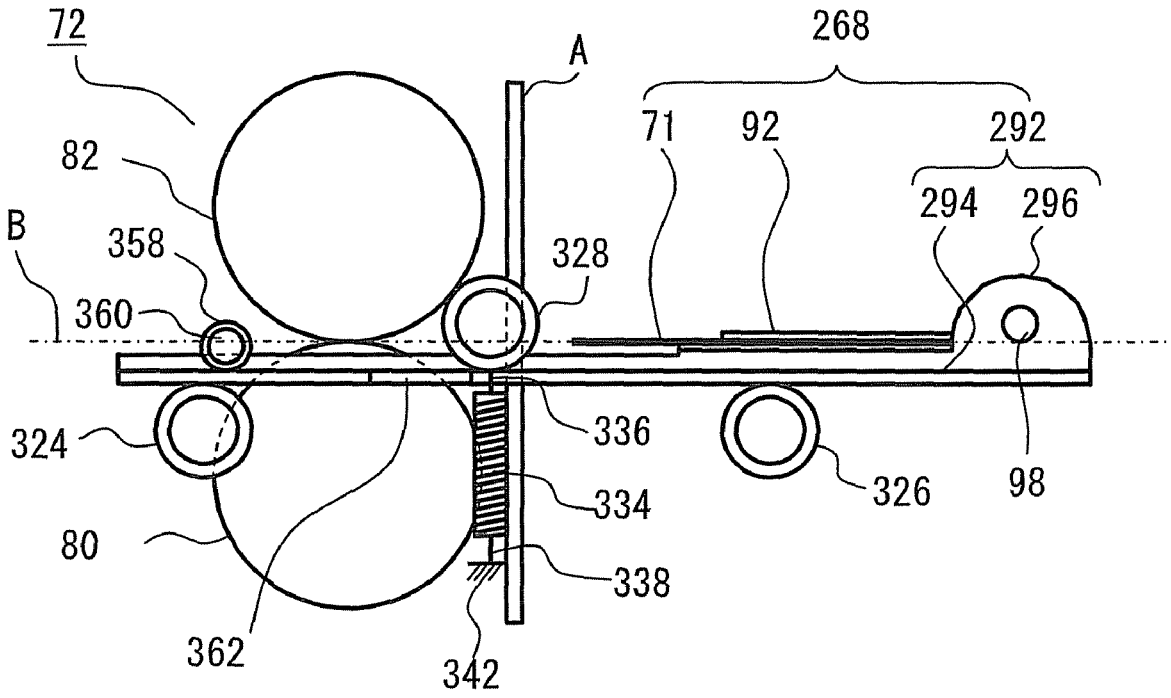
FIG. 10 is a diagram illustrating a cross sectional view of a second exemplary instance of a sheet folding unit before a blade contacts a sheet stack.
Figure 11:
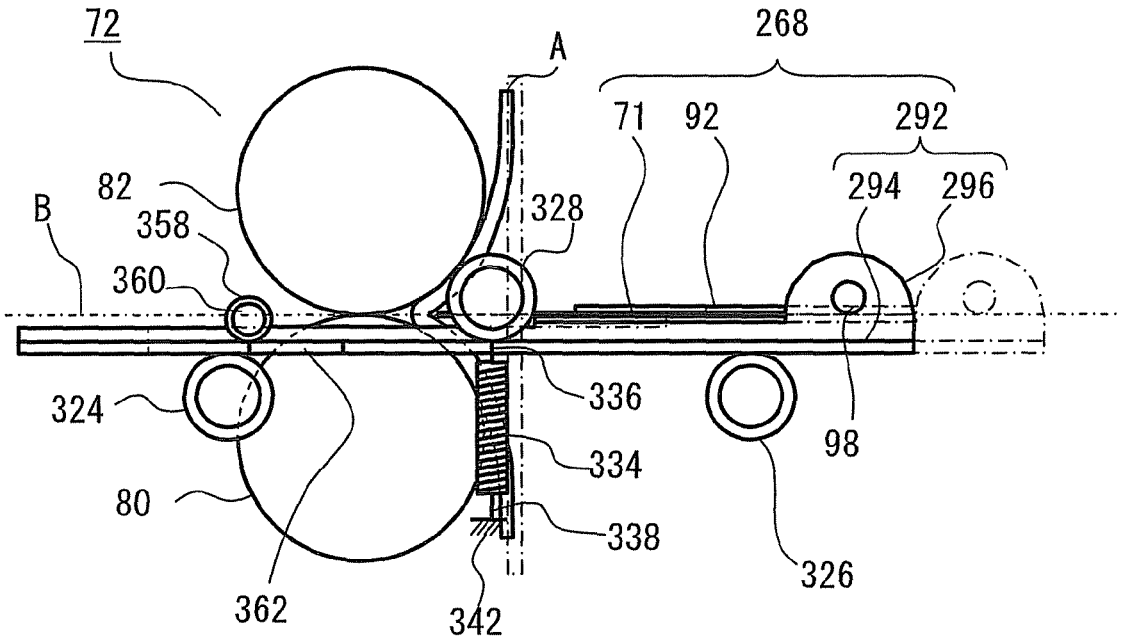
FIG. 11 is a diagram illustrating a cross sectional view of a second exemplary instance of a sheet folding unit before a blade approaches into a nip between a folding roller pair.
Figure 12:
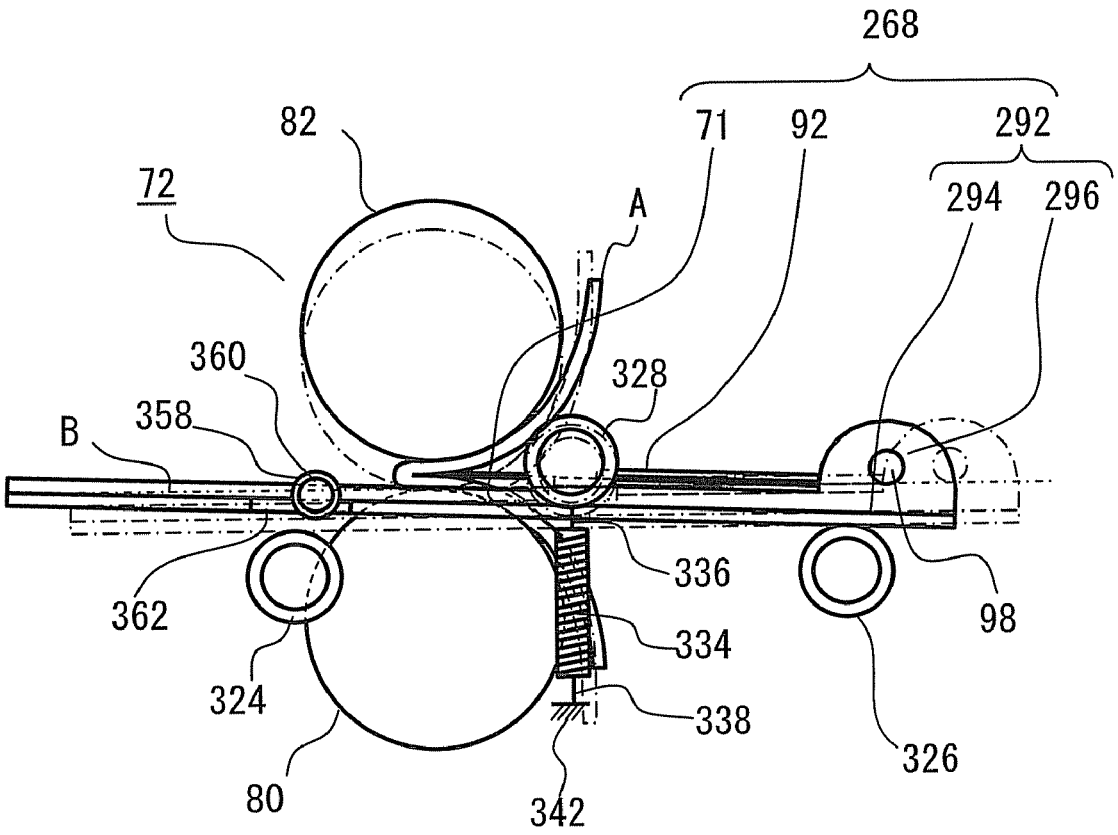
FIG. 12 is a diagram illustrating a cross sectional view of a second exemplary instance of a sheet folding unit after a folding roller pair nips a sheet stack.

An exemplary operation of the sheet folding unit is explained in FIG. 10 through FIG. 12, which illustrate cross sectional views of the sheet folding unit 72.

FIG. 10 illustrates a cross sectional view of the sheet folding unit 72 before the blade 71 contacts the sheet stack A. The regulation skid 358 is at an opposite side of the folding roller pair 70 as compared to a side where the rear stationary skid 326 is positioned. The stationary skids 320 and the regulation skid 358 pinch the blade unit 268 to provide slidable support along the line B, and the movable skid 328 biases the upper surface of the rib 296. The blade unit 268 advances linearly to contact the blade 71 at the center of the sheet stack A along the line B according to a guide provided by the regulation skid 358 and the stationary skids 320.

FIG. 11 illustrates a cross sectional view of the sheet folding unit 72 before the blade 71 approaches into the nip between the folding roller pair 70. The regulation skid 358 prevents the blade 71 from deviating from the line B due to a stress caused by a strength and a thickness of the sheet stack A after the blade 71 contacts the center of the sheet stack A until the blade unit 268 reaches a position to let the folding roller pair 70 nip the sheet stack A. An end of the slot 362 faces the regulation skid 358 to release the regulation skid 358 just before the blade 71 approaches into the nip between the folding roller pair 70. Thus, the tip of the blade 71 can be stably advanced together with the center of the sheet stack A.

FIG. 12 illustrates a cross sectional view of the sheet folding unit 72 after the folding roller pair 70 nips the sheet stack A. The slot 362 takes the regulation skid 358 in to allow the blade unit 268 to deviate the blade 71 from the line B. As a result, the tip of the blade 71 is pushed up by the sheet stack A on the lower folding roller 80. The movable skid 328 presses the guide frame 292 to pivot stably around a contact point with the rear stationary skid 326, wherein such pivot is done in a stable manner. That is, the tip of the blade 71 can be advanced together with the center of the sheet stack A. After the folding roller pair 70 nips the sheet stack A, the blade driving structure 110 backs the blade unit 268 off from the nip to position the blade 71 at the evacuating position to prepare for folding the following sheet stack. When the blade unit backs off, the slot 362 backs off together with the guide frame 292 and the regulation skid 358 comes out from the slot 362. The regulation skid 358 holds the blade unit 268 on the front stationary skid 324 to keep the blade 71 on the line B, again.

According to the above embodiment, the regulation skid 358 prevents the blade 71 from deviating from the line B due to a stress caused according to strength and a thickness of the sheet stack A after the blade 71 contacts the center of the sheet stack A. This configuration yields a more precise folding. Moreover, the slot 362 enables such function of the movable skid 328 as described in the first instance by releasing the regulation skid 358 from the guide frame 292 after the blade unit 268 reaches a position to let the folding roller pair 70 nip the sheet stack A.

The regulation skid 358 and the slot 362 may be set at other positions while keeping a positional relationship therebetween as described above. For example, the slot 362 may be set at a different position on the direction along which the guide frame 292 advances, or the slot 362 may be set on the side plate 294. Moreover, such folding units as described above work well if the folding units are configured upside down with relation to the illustrations described herein.

(3) Instance 3 of Sheet Folding Unit

Figure 13:
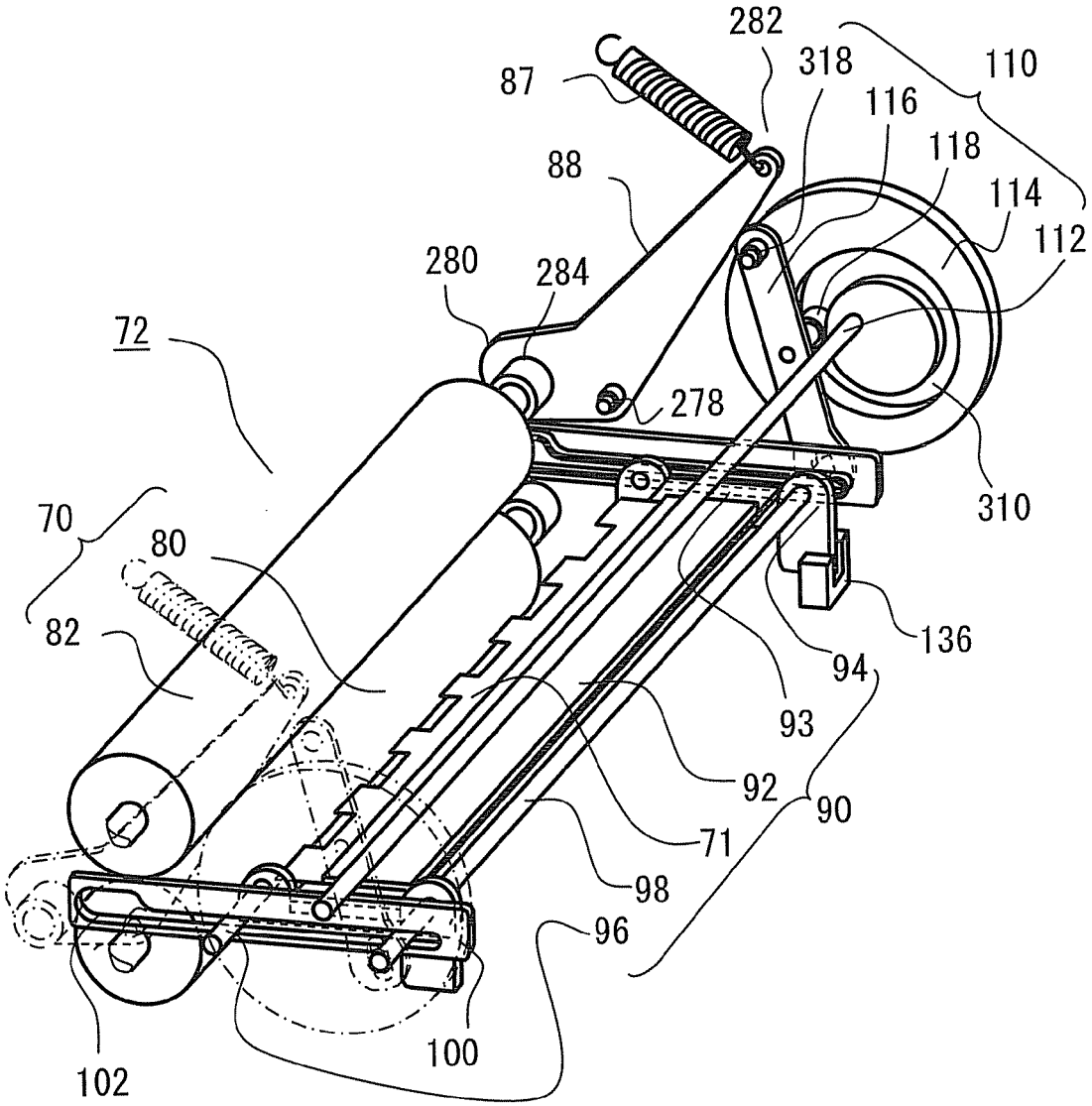
FIG. 13 is a diagram illustrating a perspective view of a third exemplary instance of a sheet folding unit.

FIG. 13 illustrates a perspective view of a third exemplary instance of the sheet folding unit 72. The sheet folding unit 72 includes the folding roller pair 70, the pair of springs 87, the pair of levers 88, the blade driving structure 110 and the position sensor 136, each of which can be substantially similar to the folding unit 72 in the first exemplary instance.

The sheet folding unit 72 includes a blade unit 90 instead of the blade unit 90 described above. The sheet folding unit 72 further includes a pair of rails 100. One of the rails in the pair 100 is positioned on a side of the first end of the folding roller pair 70, and the other is positioned on the second side of the folding roller pair 70. The blade unit 90 includes the blade 71, a first blade holder 92, a second blade holder 93, a pair of side plates 94, a pair of pins 96 and a blade shaft 98. The blade unit 90 is driven by blade driving structures 110. The pair of side plates 94 can be mutually symmetric, and support both ends of the second blade holder 93, respectively. The first blade holder 92 and the second blade holder 93 can clip the blade 71 therebetween. The pair of side plates 94 further support respective pins of the pair of pins 96 and respective sides of the blade shaft 98. Both ends of the blade shaft 98 connect to the blade driving structure 110. The pin 96 is in parallel with, and has same diameter as, the blade shaft 98. The pin 96 is in front of the blade shaft 98 in a direction that the blade 71 advances. The tip of the blade 71 is between the pin 96 and the blade shaft 98 in the direction that the blade 71 advances. The rail 100 includes a guide slot 102 to slidably support the pin 96 and an end of the blade shaft 98 to guide the blade unit 90 moving along the direction that the blade 71 advances. It is also contemplated that the guide slot 102 may support the pin 96 and the end of the blade shaft 98 through skids. The rail 100 is relatively stationary with respect to the axis around which the lower folding roller 80 rotates.

Figure 14:
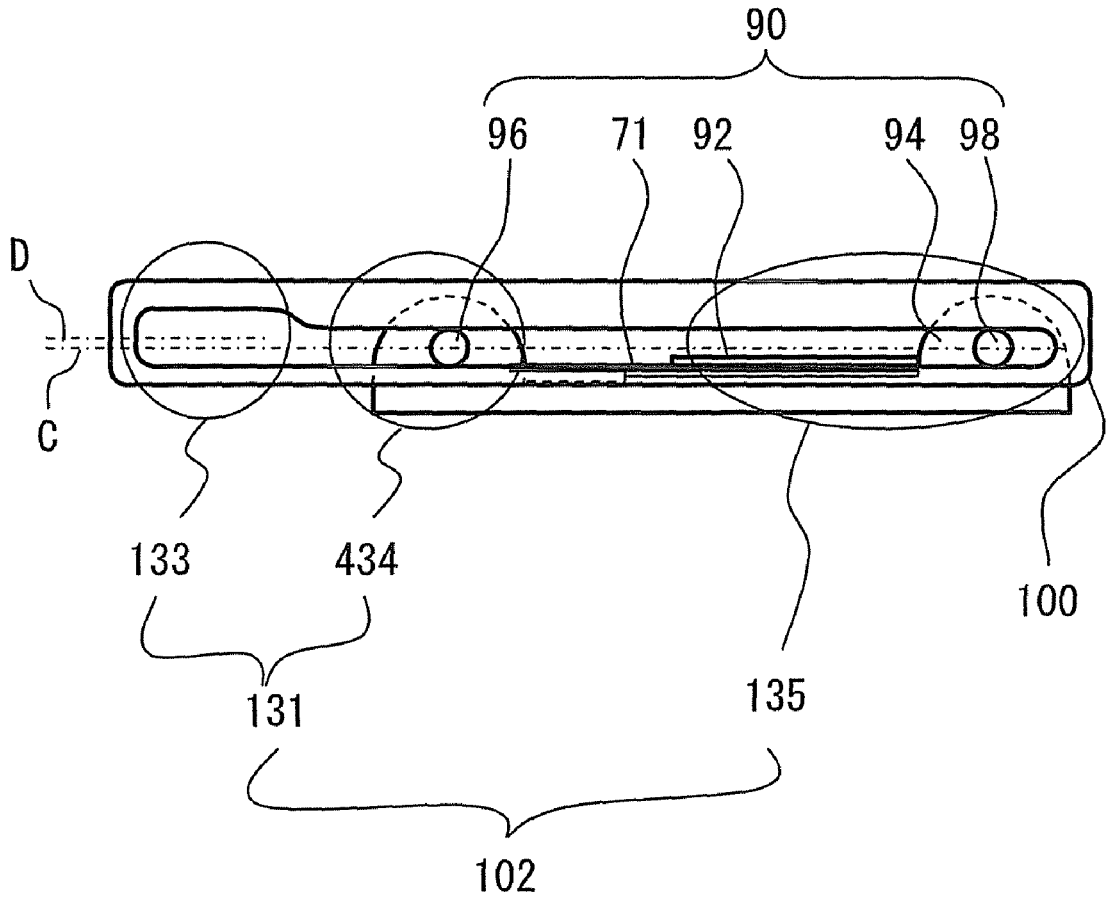
FIG. 14 is a diagram illustrating a side view of a rail and a blade unit of a third exemplary instance of a sheet folding unit.

FIG. 14 illustrates a side view of the rail 100 and the blade unit 90. The guide slot 102 includes a first stage 131 and a second stage 135. The first stage 131 guides the pin 96 inserted therein. The second stage 135 guides the blade shaft 98 inserted therein. Furthermore, the first stage 131 includes a first section 434 and a second section 133. An end of the second section 133 connects continuously to a front side of the first section 434, and the first section 434 connects continuously to a front side of the second stage 135, in a direction that the blade 71 advances.

The first section 434 and the second stage 135 have respective heights sufficient for the pin 96 to slide without staggering. A first edge of the guide slot 102 has a straight shape perpendicular to a line connecting between the axes of the lower folding roller 80 and the upper folding roller 82 through the second stage 135, the first section 434 and the second section 133. On the other hand, a second edge which is closer to the upper folding roller 82 than the first edge ascends and plateaus to the upper folding roller 82 side from a straight shape perpendicular to the line at the second section 133 although the straight shape continues through the second stage 135 and the first section 434. Therefore, a height of the second section 133 is greater than the height of the first section 434 and the second stage 135, and a centerline D of the second section 133 is on the upper folding roller 82 side of a common centerline C of the first section 434 and the second stage 135. The height at the end of the second section 133 is smoothly reduced to connect continuously to the front side of the first section 434.

An exemplary operation of the sheet folding unit is explained in FIG. 15 through FIG. 18, which illustrate cross sectional views of the sheet folding unit 72.

Figure 15:
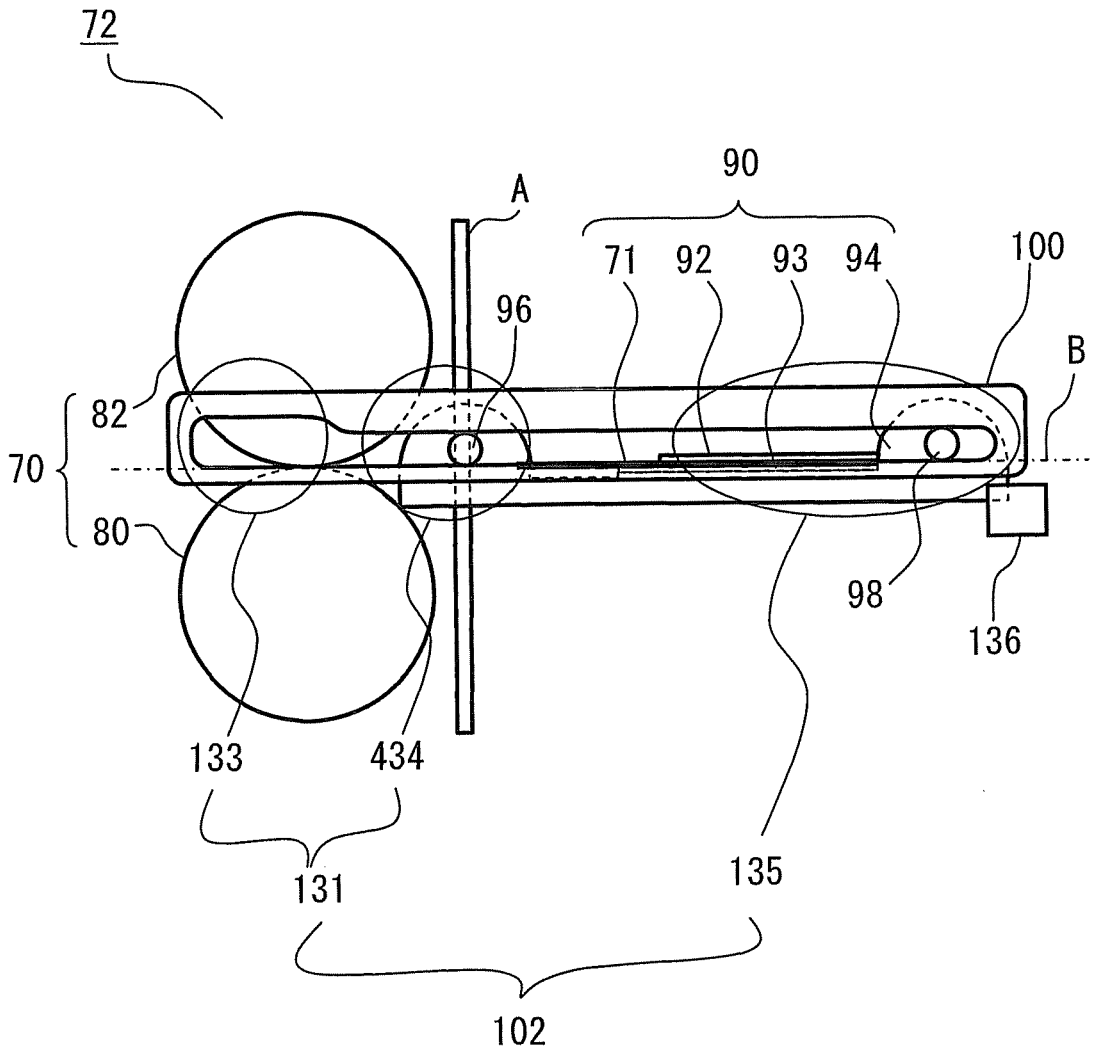
FIG. 15 is a diagram illustrating a cross sectional view of a third exemplary instance of a sheet folding unit before a blade contacts a sheet stack.

FIG. 15 illustrates a cross sectional view of the sheet folding unit 72 before the blade 71 contacts the sheet stack A. The pin 96 is inserted into the first section 434 of the guide slot 102, and the blade shaft 98 is inserted into the second stage 135 of the guide slot 102. As a result, the pin 96 and the blade shaft 98 do not stagger perpendicularly to the first edge of the guide slot 102, yet the pin 96 and the blade shaft 98 can move in parallel with the first edge of the guide slot 102. A dashed line B is a common tangential line to the lower folding roller 80 and the upper folding roller 82 at their nip. The line B is in parallel with the first edge of the guide slot 102 which has a straight shape through the second stage 135, the first section 434 and the second section 133. A center of a face of the sheet stack A faces the tip of the blade 71. The blade 71 is set along the line B to push an accurate position on the sheet stack A, and remains at a retracting position to avoid interfering with the sheet stack A sliding down. The position sensor 136 may confirm that the blade 71 is located at the evacuating position.

Figure 16:
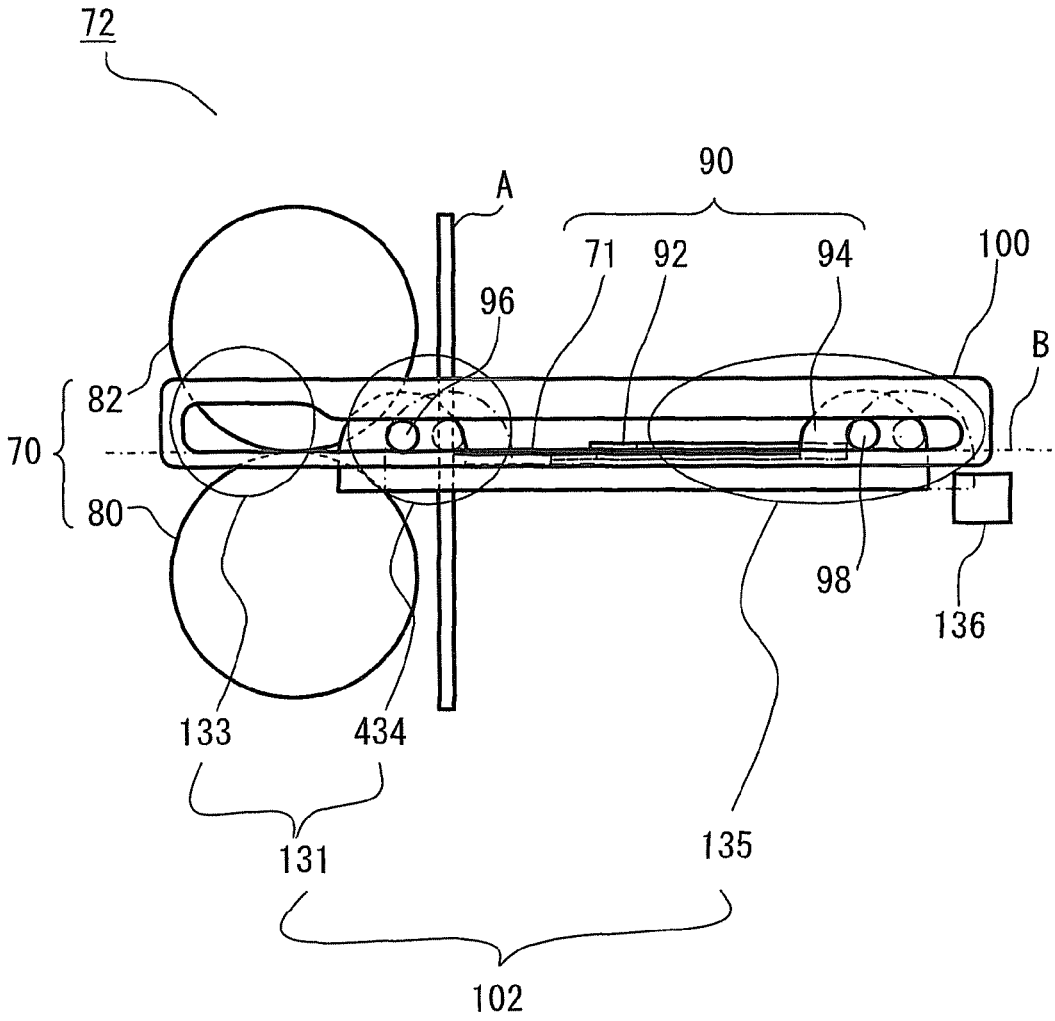
FIG. 16 is a diagram illustrating a cross sectional view of a third exemplary instance of a sheet folding unit when a blade contacts a center of a sheet stack.

FIG. 16 illustrates a cross sectional view of the sheet folding unit 72 when the blade 71 contacts the center of the sheet stack A after the blade unit 90 starts to advance along the line B. At this time, the pin 96 does not stagger perpendicularly to the first edge of the guide slot 102 because the pin 96 is still moving in the first section 434. Therefore, the tip of the blade 71 catches the accurate position on the sheet stack A, and continues to advance while maintaining the accurate position. After the blade 71 contacts the center of the sheet stack A, the blade unit 90 advances further along the line B to let the folding roller pair 70 nip the sheet stack A.

Figure 17:
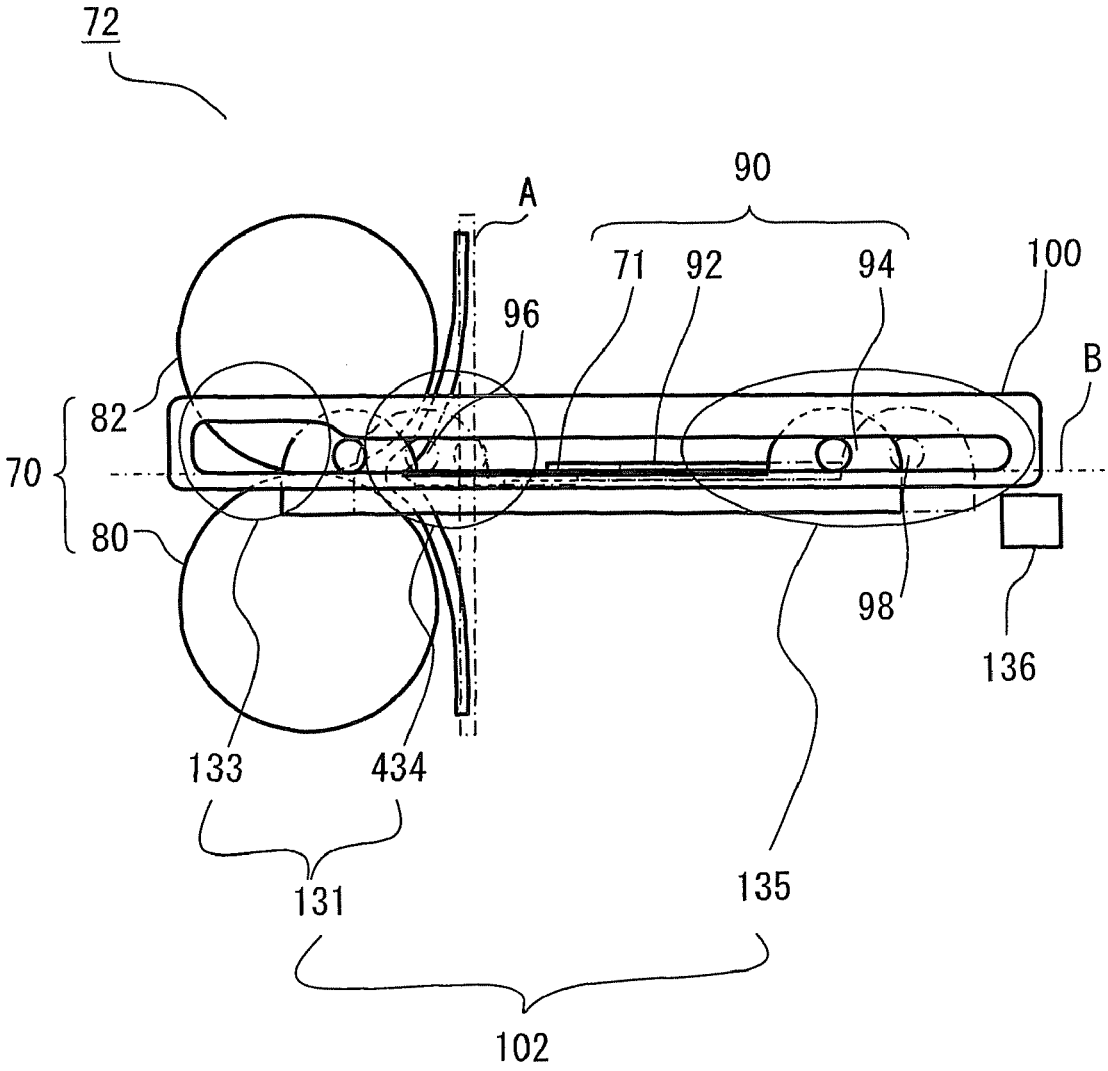
FIG. 17 is a diagram illustrating a cross sectional view of a third exemplary instance of a sheet folding unit before a blade approaches into a nip between a folding roller pair but after a sheet stack contacts a folding roller pair.

FIG. 17 illustrates a cross sectional view of the sheet folding unit 72 before the blade 71 approaches into the nip between the folding roller pair 70 while the sheet stack A contacts the folding roller pair 70. At this time, a position of a fold on the sheet stack A is almost fixed by a pinch between the blade 71 and rounded surfaces of the folding roller pair 70. The pin 96 enters into the end of the second section 133 through the front side of the first section 434. Because the second section 133 rises from the first section 434 continuously, the pin 96 progressively obtains a clearance to deviate away from a straight line parallel with the line B.

Figure 18:
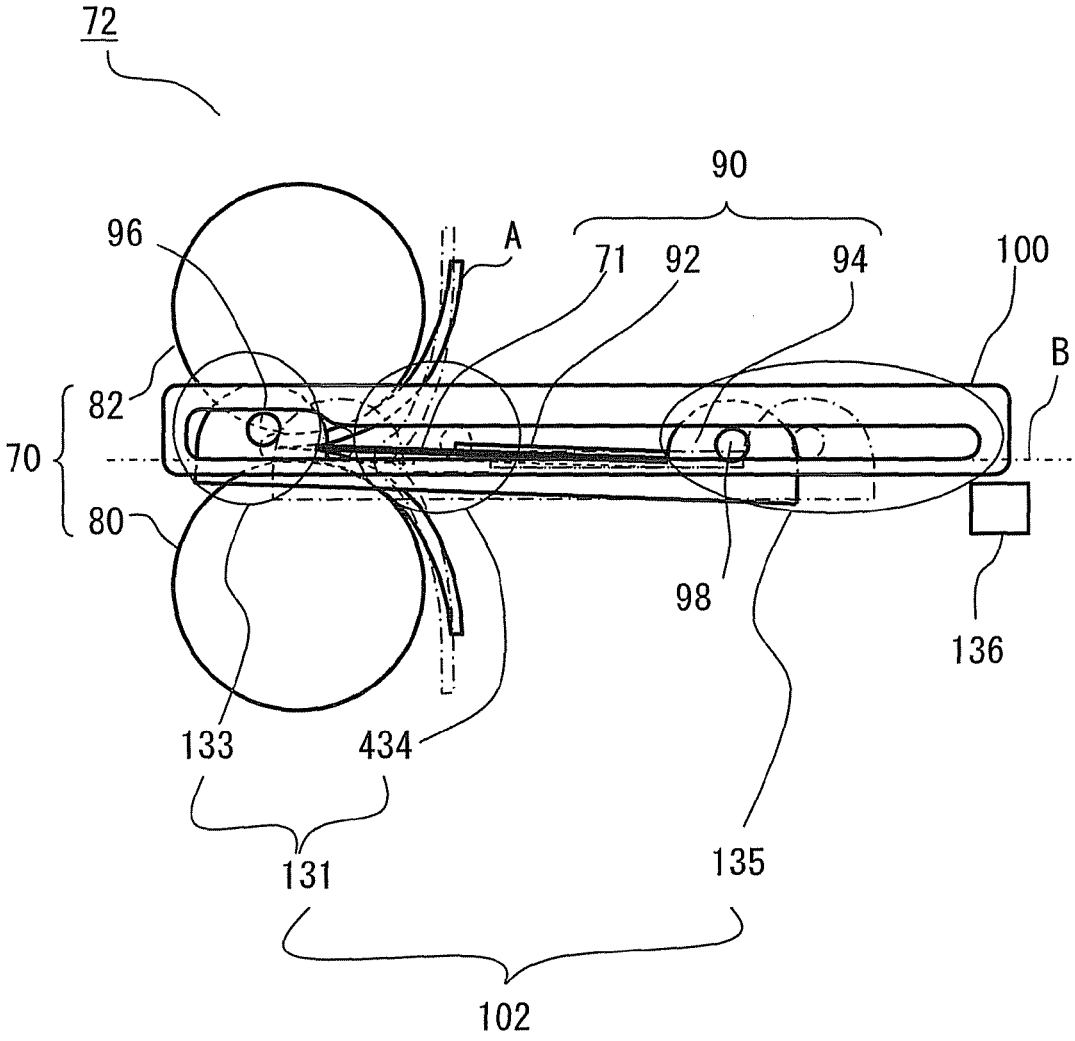
FIG. 18 is a diagram illustrating a cross sectional view of a third exemplary instance of a sheet folding unit after a folding roller pair nips a sheet stack.

FIG. 18 illustrates a cross sectional view of the sheet folding unit 72 after the folding roller pair 70 nips the sheet stack A. The nip of the folding roller pair 70 is pushed up by about twice of the thickness of the sheet stack A at the upper folding roller 82 side only, because the lower folding roller 80 does not move against the rail 100. Therefore, the tip of the blade 71 is pushed up by the sheet stack A on the lower folding roller 80. The second section 133 allows a deviation of the tip of the blade 71 to be pushed up following the fold of the sheet stack A from the line B because the second section 133 has a clearance for the pin 96 to deviate upwards from the straight line parallel with the line B. The blade 71 rotates with the entirety of the blade unit 90 around the blade shaft 98. The length of the first section 434 may be designed so as to regulate the pin 96 not to deviate before the blade 71 allows the folding roller pair 70 to nip the most thick sheet stack stably, or so as to have a margin to deviate before the blade 71 enables the folding roller pair 70 to nip the most thick sheet stack stably after the tip of the blade 71 contacts the sheet stack A. After the folding roller pair 70 nips the sheet stack A stably, the blade unit 90 starts to back off. The pin 96 fits into the first section 434 again with help of the second edge of the guide slot 102, which is smoothly continuing to the front side of the first section 434. The blade 71 recovers into the line B.

(4) Instance 4 of Sheet Folding Unit

Figure 19:
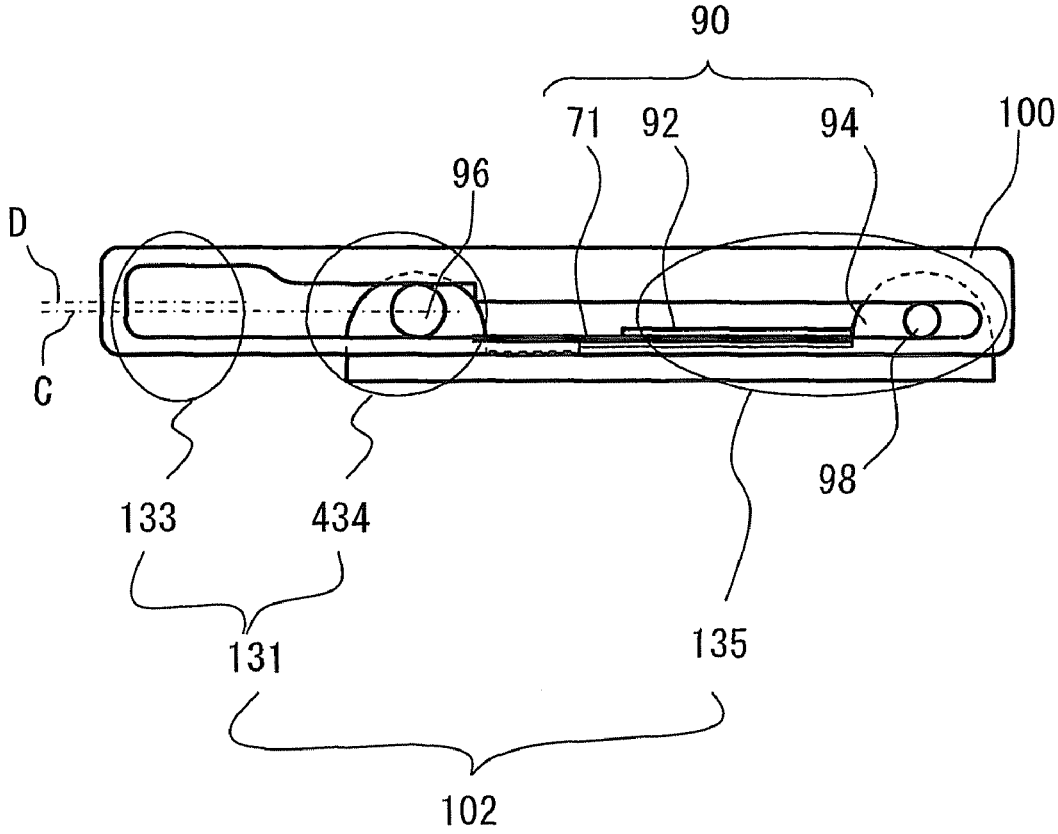
FIG. 19 is a diagram illustrating a side view of a rail and a blade unit of a fourth exemplary instance of a sheet folding unit.

FIG. 19 illustrates a side view of a rail 100 and a blade unit 90 of a fourth exemplary instance of the sheet folding unit 72. The pin 96 has larger diameter than the blade shaft 98, and the first section 434 has greater height than the second stage 133, which is sufficient for the pin 96 to slide without staggering.

Figure 20:
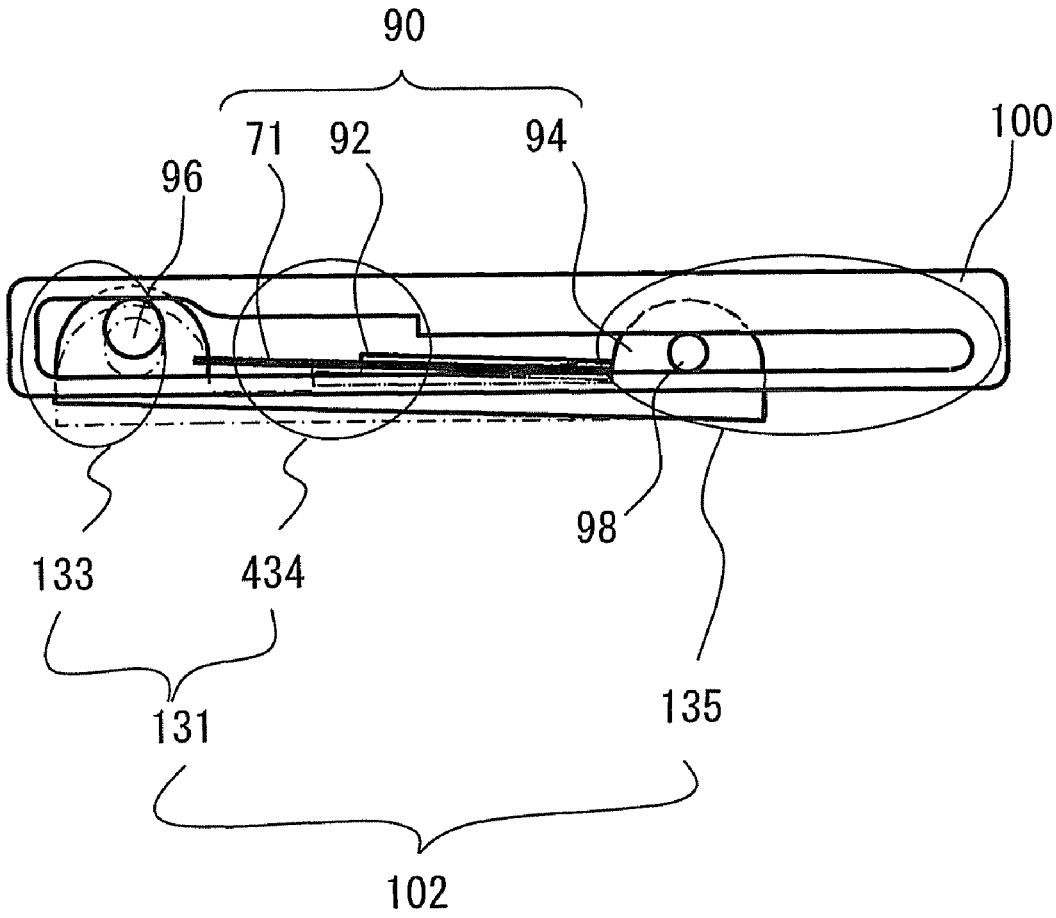
FIG. 20 is a diagram illustrating a cross sectional view of a fourth exemplary instance of a sheet folding unit with a pin in a second section of a guide slot of a rail.

FIG. 20 illustrates a cross sectional view of the sheet folding unit 72 with the pin 96 in the second section 133 where the pin 96 can raise up when the blade 71 is pushed up by the sheet stack A on the lower folding roller 80. When the blade unit 90 backs off, the larger diameter of the pin 96 eases and smoothes transitioning through a curving region from the second section 133 to the first section 434 and fitting into the first section 434.

According to another example, the pin 96 may be smaller than the blade shaft 98, and then the first section 434 may be smaller than the second stage 135.

(5) Instance 5 of Sheet Folding Unit

Figure 21:
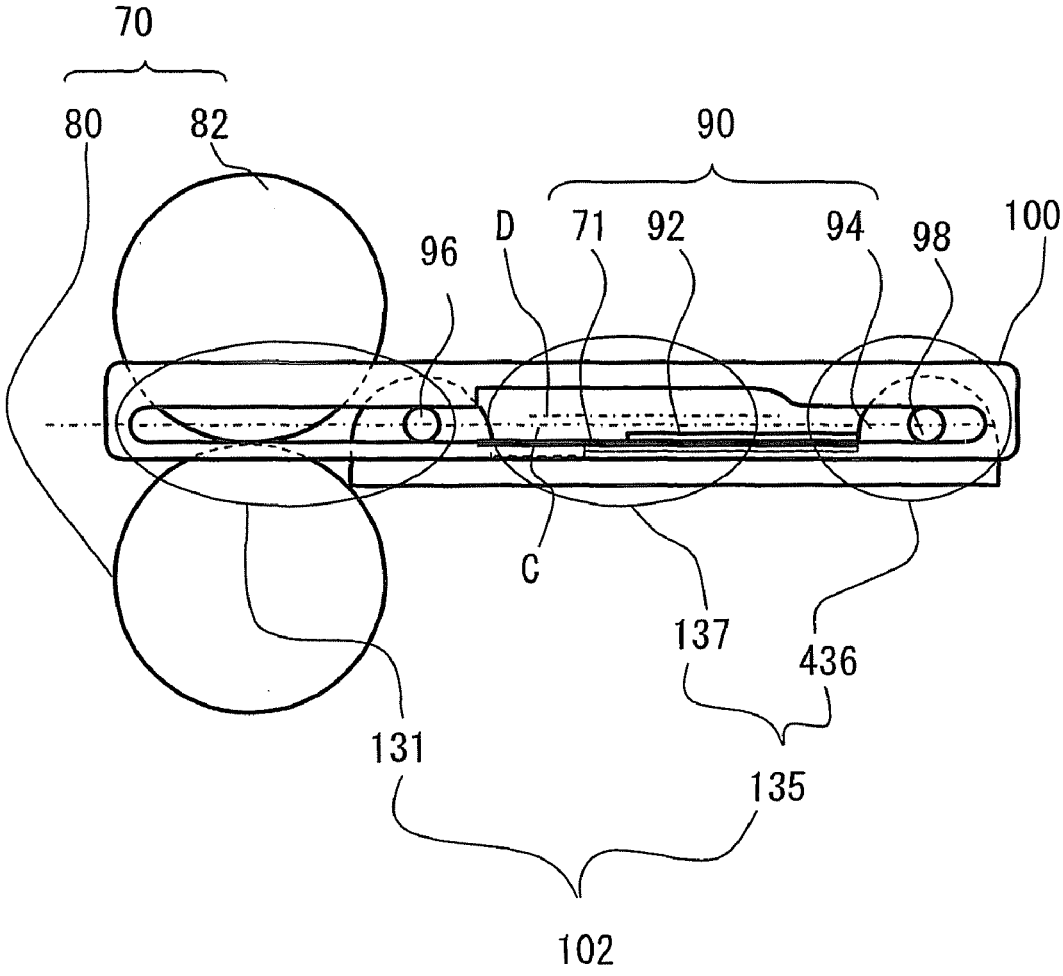
FIG. 21 is a diagram illustrating a side view of a rail and a blade unit of a fifth exemplary instance of a sheet folding unit.

FIG. 21 illustrates a side view of a rail 100 and a blade unit 90 of a fifth exemplary instance of the sheet folding unit 72. In this instance, the upper folding roller 82 is relatively stationary with respect to the rail 100, and the lower folding roller 82 presses up against the upper folding roller 80. The guide slot 102 includes a first stage 131 and a second stage 135. The first stage 131 guides the pin 96 inserted therein. The second stage 135 guides the blade shaft 98 inserted therein. Furthermore, the second stage 135 includes a third section 436 and a fourth section 137. A first end of the fourth section 137 connects continuously to a front side of the third section 436 in a direction along which the blade 71 advances, and a second end of the fourth section 137 connects to the first stage 131. The first stage 131 has a height sufficient enough for the pin 96 to slide without staggering. The third section 436 has a height sufficient enough for the blade shaft 98 to slide without staggering. The first stage 131 and the third section 436 may have the same height as each other if the pin 98 and the blade shaft 98 are about the same in diameter as illustrated in FIG. 21; however, the claimed subject matter is not so limited. A first edge of the guide slot 102 has a straight edge perpendicular to a line connecting the axes of the lower folding roller 80 and the upper folding roller 82 through the first stage 131, the fourth section 137 and the third section 436. On the other hand, a second edge which is closer to the upper folding roller 82 than the first edge ascends and plateaus to the upper folding roller 82 side from a straight shape perpendicular to the line at the fourth section 137 although the second stage 135 and the first section 434 align their edge in the straight shape. Therefore, the height of the fourth section 137 is bigger than the height of third section 436 and the first stage 131, and a centerline of the fourth section 137 is on the upper folding roller 82 side of a common centerline of the third section 436 and the first stage 131.

Figure 22:
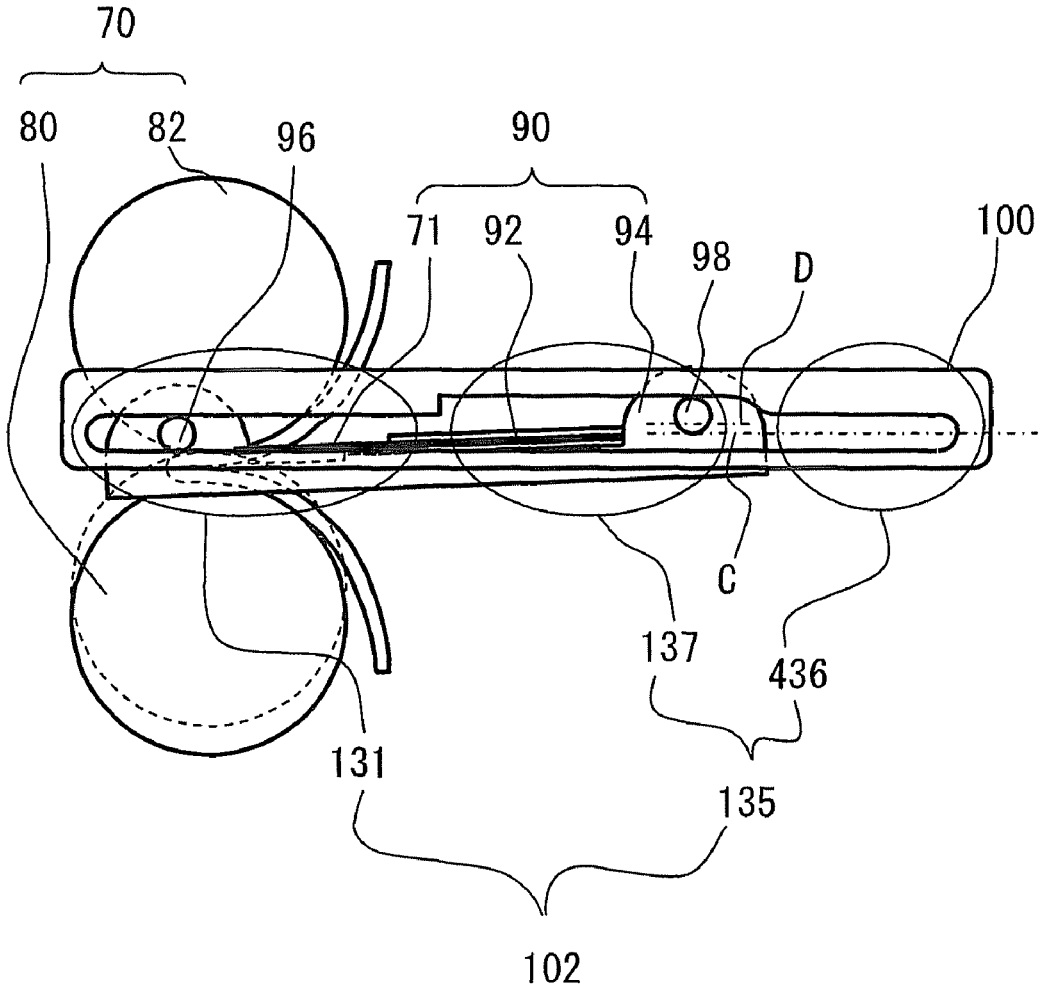
FIG. 22 is a diagram illustrating a cross sectional view of a fifth exemplary instance of a sheet folding unit with a blade shaft in a fourth section of a guide slot of a rail.

FIG. 22 illustrates a cross sectional view of the sheet folding unit 72 with the blade shaft 98 in the fourth section 137 where the blade shaft 98 can raise up when the blade 71 is pushed down by the sheet stack A below the upper folding roller 82. In this instance, the tip of the blade 71 is pushed down because the upper folding roller 82 does not move up but the lower folding roller 80 moves down against the rail 100. The fourth section 137 allows a deviation of the tip of the blade 71 to be pushed down following the fold of the sheet stack A from the common centerline because the fourth section 137 has a clearance for the blade shaft 98 to deviate downward from the common centerline. The blade 71 rotates with the whole of the blade unit 90 around the pin 96

(6) Instance 6 of Sheet Folding Unit

Figure 23:
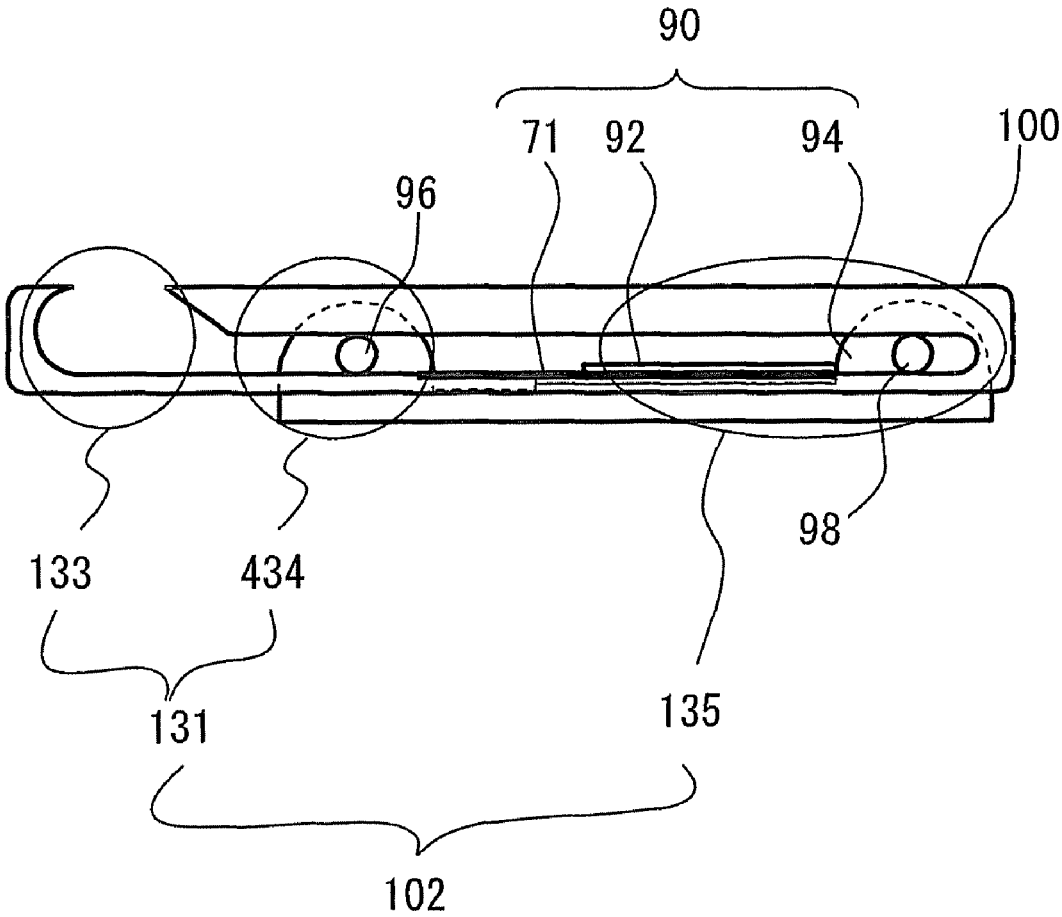
FIG. 23 is a diagram illustrating a side view of a rail and a blade unit of a sixth exemplary instance of a sheet folding unit.

FIG. 23 illustrates a side view of a sixth exemplary instance of the rail 100 and the blade unit 90 of the sheet folding unit 72. The rail 100 has the same configuration as the first exemplary instance except for the second edge which is closer to the upper folding roller 82 than the first edge. The first edge is terminated at the second section 133 as an opening although the straight shape continues through the second stage 135 and the first section 434. The edge of the second section 133 appears at a first end to connect continuously to the front side of the first section 434. The height at the end of the second section 133 is smoothly reduced to the front side of the first section 434. The opening allows a deviation of the tip of the blade 71 pushed up following the fold of the sheet stack A from the line B.

(7) Instance 7 of Sheet Folding Unit

Figure 24:
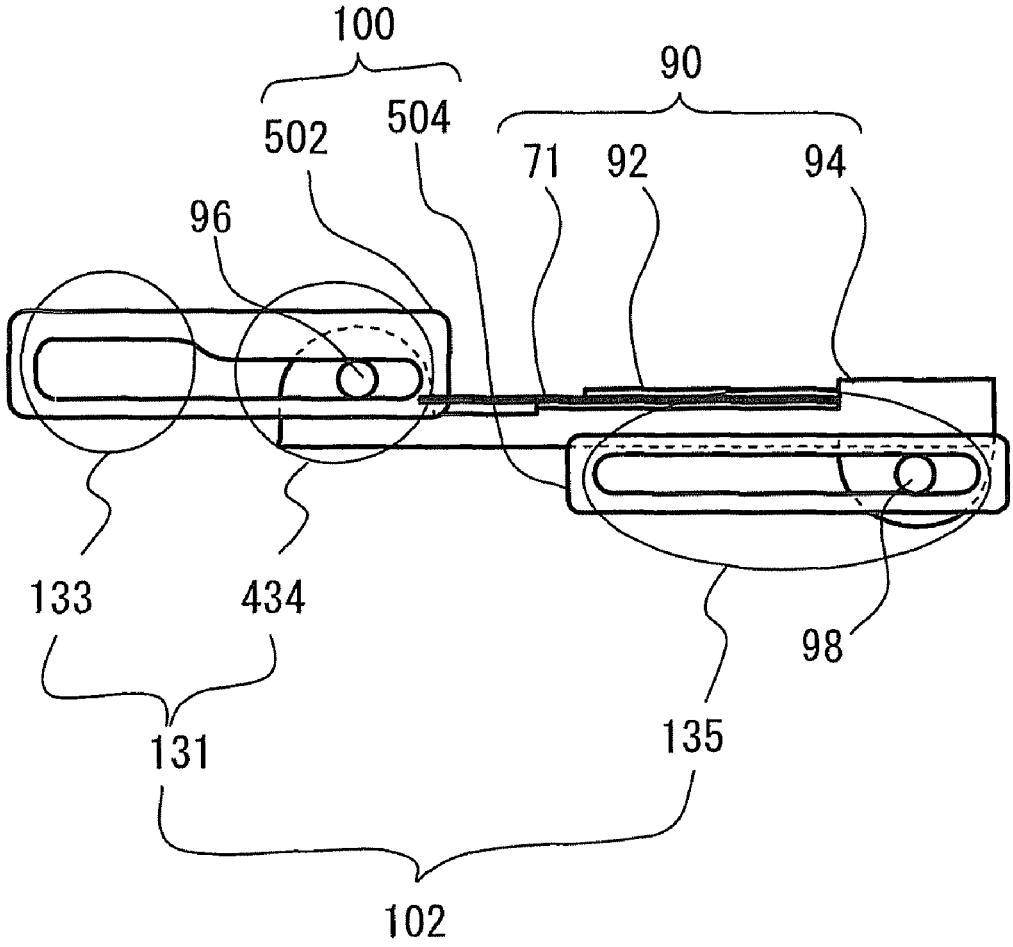
FIG. 24 is a diagram illustrating a side view of a rail and a blade unit of a seventh exemplary instance of a sheet folding unit.

FIG. 24 illustrates a side view of a seventh exemplary instance of the rail 100 and the blade unit 90 of the sheet folding unit 72. The rail 100 is divided into a first piece 502 and a second piece 504 as well as the guide slot 102. The first stage 131 is opened on the first piece 502, and the second stage 135 is opened on the second piece 504. Openings of the first stage 131 and the second stage 135 are terminated therebetween not to connect. A first edge of the first stage 131 is straight and parallel with a first edge of the second stage 135. A second edge of the first stage 131 is partially straight (e.g., the first section 434) and parallel with a second edge of the second stage 135, but the end of the second section 133 rounds to connect smoothly the first section 434. The first section 434 has a height sufficient enough for the pin 96 to slide without staggering, and the second stage 135 has a height sufficient enough for the blade shaft 98 to slide without staggering, and the second section 133 has a height sufficient enough for the pin 96 to deviate the tip of the blade 71 from the common tangential line to the folding roller pair 70 at the nip. Shortening a slot on a rail piece improves a stiffness of the slot. Therefore, such configuration in this instance reduces staggers of the pin 96 and the blade shaft 98 as well as the blade 71.

Although the blade 71 moves linearly in above explained instances, the blade 71 may be configured to move in a rounded orbit if the skids and the guide slots are laid out along the orbit.

(8) Instance 8 of Sheet Folding Unit

Figure 25:
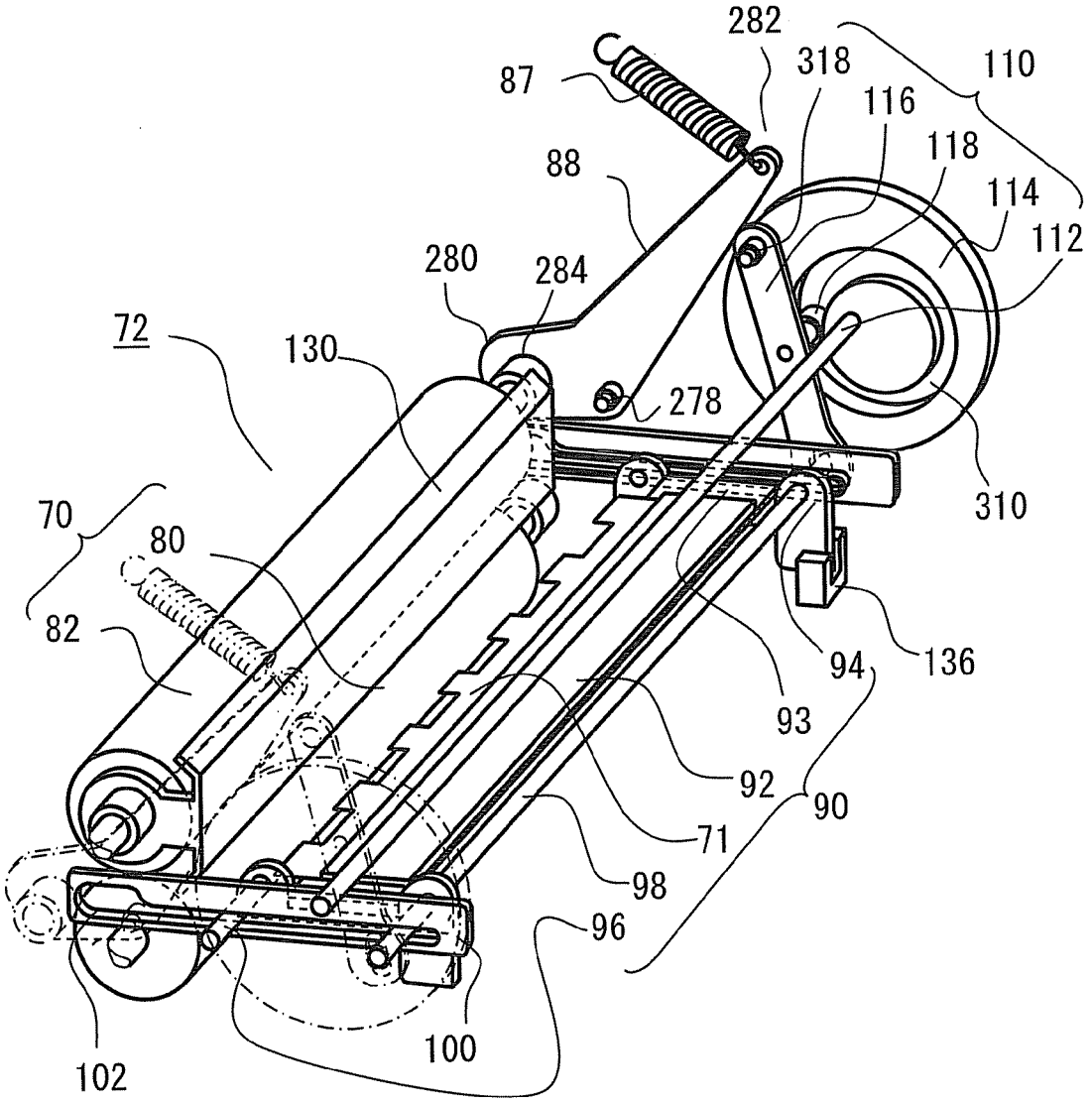
FIG. 25 is a diagram illustrating a perspective view of an eighth exemplary instance of a sheet folding unit.

FIG. 25 illustrates a perspective view of an eighth exemplary instance of the sheet folding unit 72. The sheet folding unit 72 includes a roller cover 130 in addition to the features of the third exemplary instance. The roller cover 130 covers the upper folding roller 82 at the upper wall panel 155 side of a line connecting the axes of the lower folding roller 80 and the upper folding roller 82.

Figure 26:
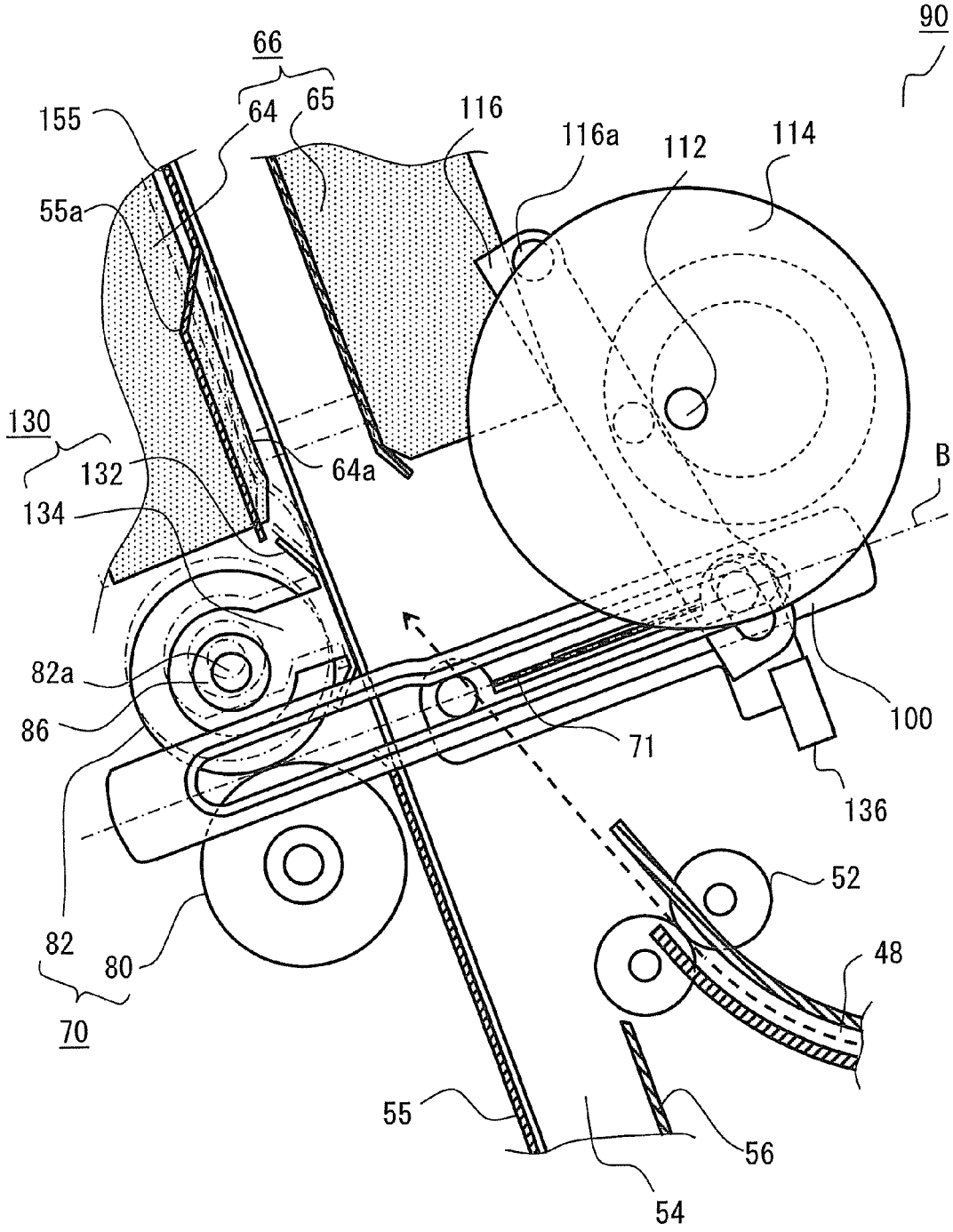
FIG. 26 is a diagram illustrating a side view around an eighth exemplary instance of a sheet folding unit.

FIG. 26 illustrates a side view around the sheet folding unit 72. The roller cover 130 is above line B which is a common tangential line to the lower folding roller 80 and the upper folding roller 82 at their nip. The lower wall panel 55 is below the line B to cover the lower folding roller 80. The roller cover 130 and the lower wall panel 55 have a clearance to let the blade 71 pass through therebetween. The roller cover 130 and the lower wall panel 55 support the sheet together with the stacker 58 in a tilted position. The roller cover 130 and the lower wall panel 55 contact on the folding roller pair 70 side of the sheet stack. The lower wall panel 55 bends at an upper side which is closer to the nip to guide the sheet stack to the nip smoothly.

The roller cover 130 includes a guide board 132 and a supporting plate 134. The guide board 134 contacts the sheet stack supported on the stacker 58 and the lower wall panel 55. The guide board 134 bends at a lower side which is closer to the nip to guide the sheet stack to the nip smoothly. The supporting plate 134 supports the guide board 132 stationary with respect to the axis of the upper folding roller 82. That is, the roller cover 130 does not rotate, but shifts parallelly together with the upper folding roller 82. The supporting plate 134 is supported by a guide fastener 86. The guide fastener 86 rotates against the movable shaft 82*a* which rotates together with the upper folding roller 82. If the movable shaft 82*a* does not rotate against the lever 88 and the upper folding roller 82 rotates against the movable shaft 82*a*, the guide fastener 86 is not necessary.

The second path 54 is sandwiched by the lower wall panel 55 and the ceiling plate 56 at a lower region, and is sandwiched by the upper wall panel 155 and the ceiling plate 56 at an upper region. The lower wall panel 55 and the upper wall panel 155 tilt from vertical. Because the first path 48 curves upward at an end but is not connected to the second path 54 linearly, the injection roller pair 52 injects the sheet to the second path 54 upward with an attack angle against the second path 54. In other words, the injection roller pair 52 injects the sheet to the second path 54 not in parallel with the second path 54. The roller cover 130 prevents the upper folding roller 82 from directing a sheet, which is discharged from the first path 48 and the injection roller pair 52 or is climbing up the slope of the lower wall panel 55 or sliding down the slope of the upper wall panel 155, into the nip by deflecting the tip of the sheet.

The upper wall panel 155 includes a concave portion 55*a* around an aperture 64*a* of the stapler head 64. The concave portion 55*a* deviates from the second path 54 side. The concave portion 55*a* provides a clearance for the sheet stack not to be wrinkled when the aperture 64*a* is pushed into the upper wall panel 155 by the anvil 65 which projects to staple the sheet stack. The guide board 134 also bends at an upper side which is closer to the concave portion 55*a* so as to not interfere with the upper wall panel 155 and not inhibit the movement of the upper folding roller 82.

An exemplary operation of the sheet folding unit is explained in FIG. 27 through FIG. 30, which illustrate cross sectional views of the sheet folding unit 72.

Figure 27:
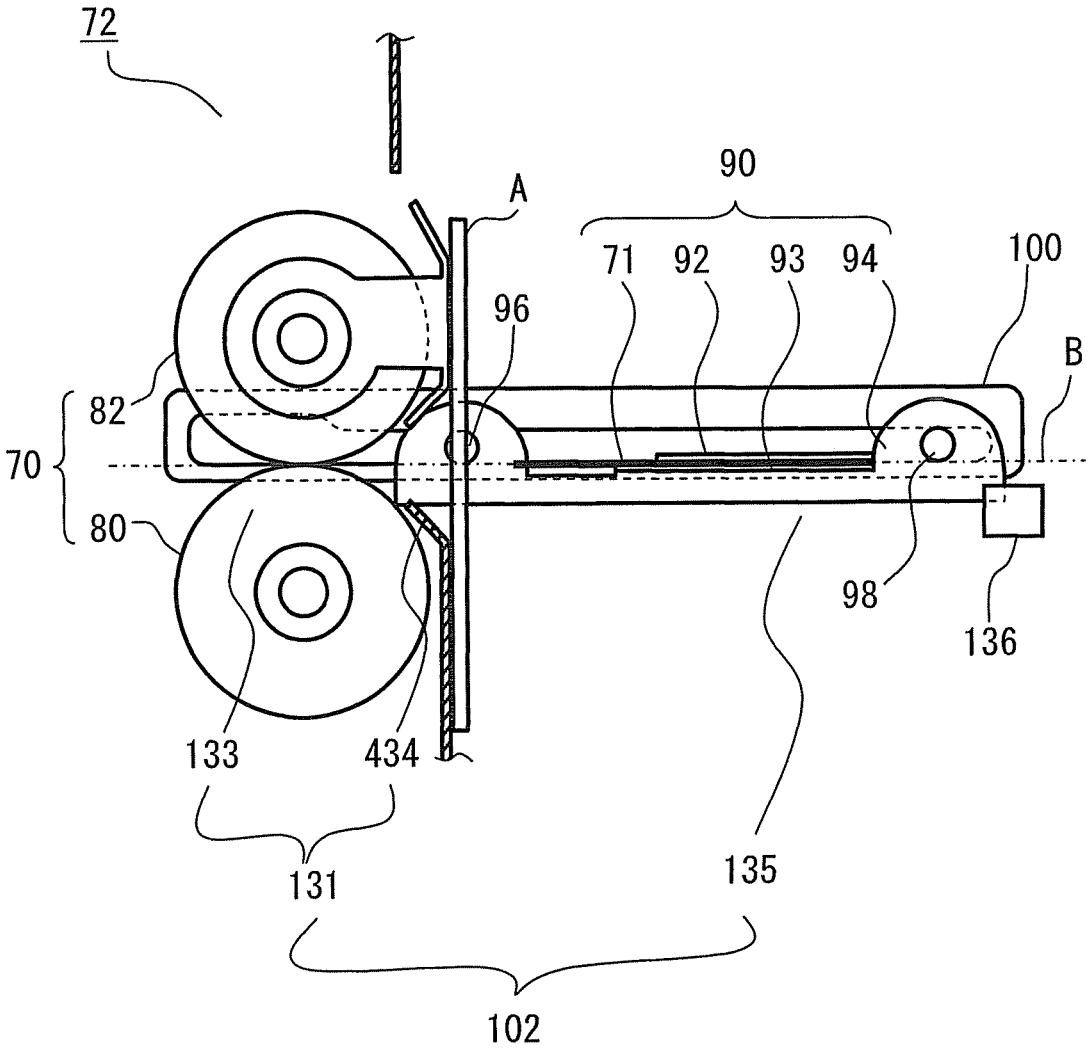
FIG. 27 is a diagram illustrating a cross sectional view of an eighth exemplary instance of a sheet folding unit before a blade contacts a sheet stack.

FIG. 27 illustrates a cross sectional view of the sheet folding unit 72 before the blade 71 contacts the sheet stack A. The blade 71 moves in parallel without staggering along a dashed line B which is a common tangential line to the lower folding roller 80 and the upper folding roller 82 at their nip.

Figure 28:
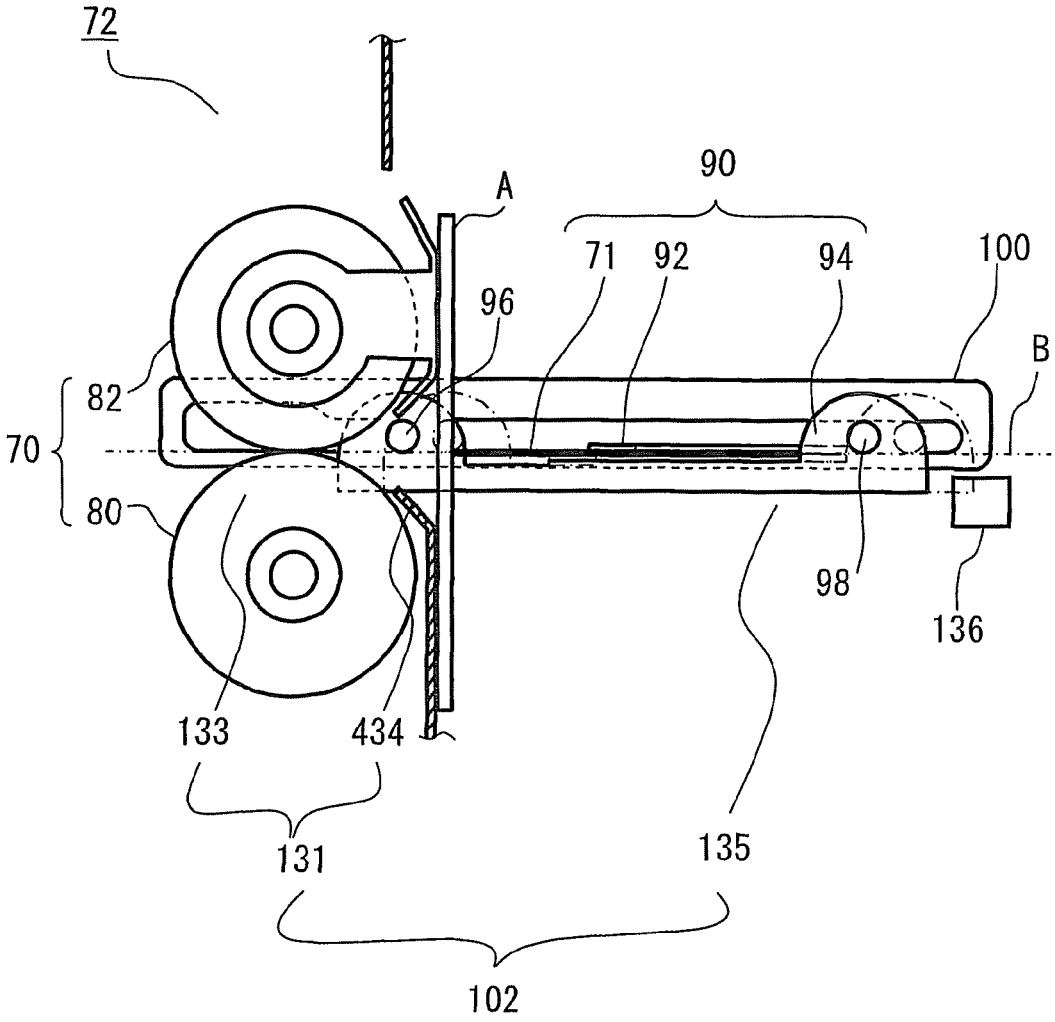
FIG. 28 is a diagram illustrating a cross sectional view of an eighth exemplary instance of a sheet folding unit when a blade contacts a center of a sheet stack.

FIG. 28 illustrates a cross sectional view of the sheet folding unit 72 when the blade 71 contacts the center of the sheet stack A, after the blade unit 90 starts to advance along the line B. The tip of the blade 71 catches the accurate position on the sheet stack A, and continues to advance with maintaining the accurate position. After the blade 71 contacts the center of the sheet stack A, the blade unit 90 advances further along the line B to let the folding roller pair 70 nip the sheet stack A.

Figure 29:
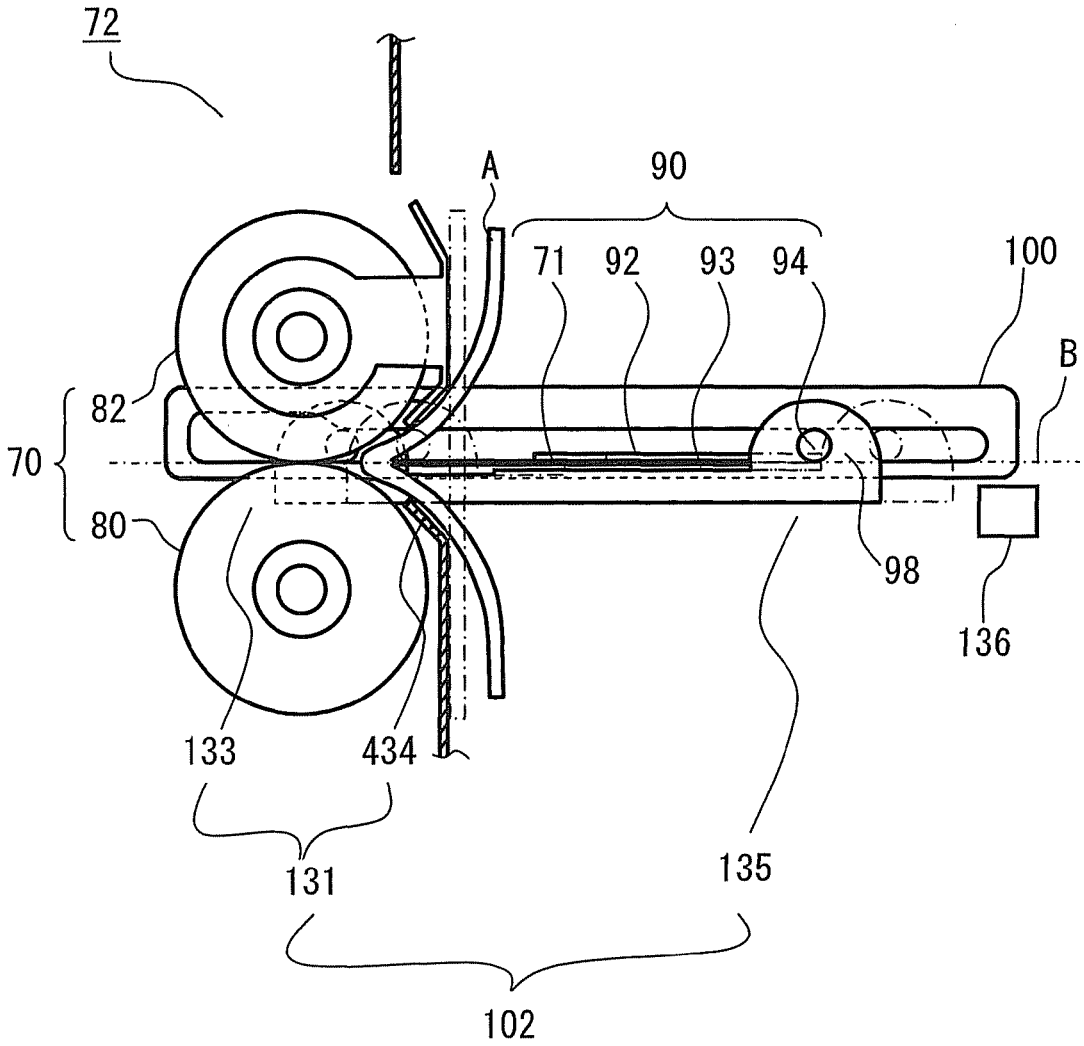
FIG. 29 is a diagram illustrating a cross sectional view of an eighth exemplary instance of a sheet folding unit before a blade approaches into a nip between a folding roller pair but after a sheet stack contacts a folding roller pair.

FIG. 29 illustrates a cross sectional view of the sheet folding unit 72 before the blade 71 approaches into the nip between the folding roller pair 70 but after the sheet stack A contacts the folding roller pair 70. At this time, a position of a fold on the sheet stack A has been almost fixed by a pinch between the blade 71 and rounded surfaces of the folding roller pair 70. The bended sides of the guide board 132 and the lower wall panel 55 prevent the sheet stack A from contacting the folding roller pair 70 except for a region around the fold, and guide the sheet stack A to the nip smoothly.

Figure 30:
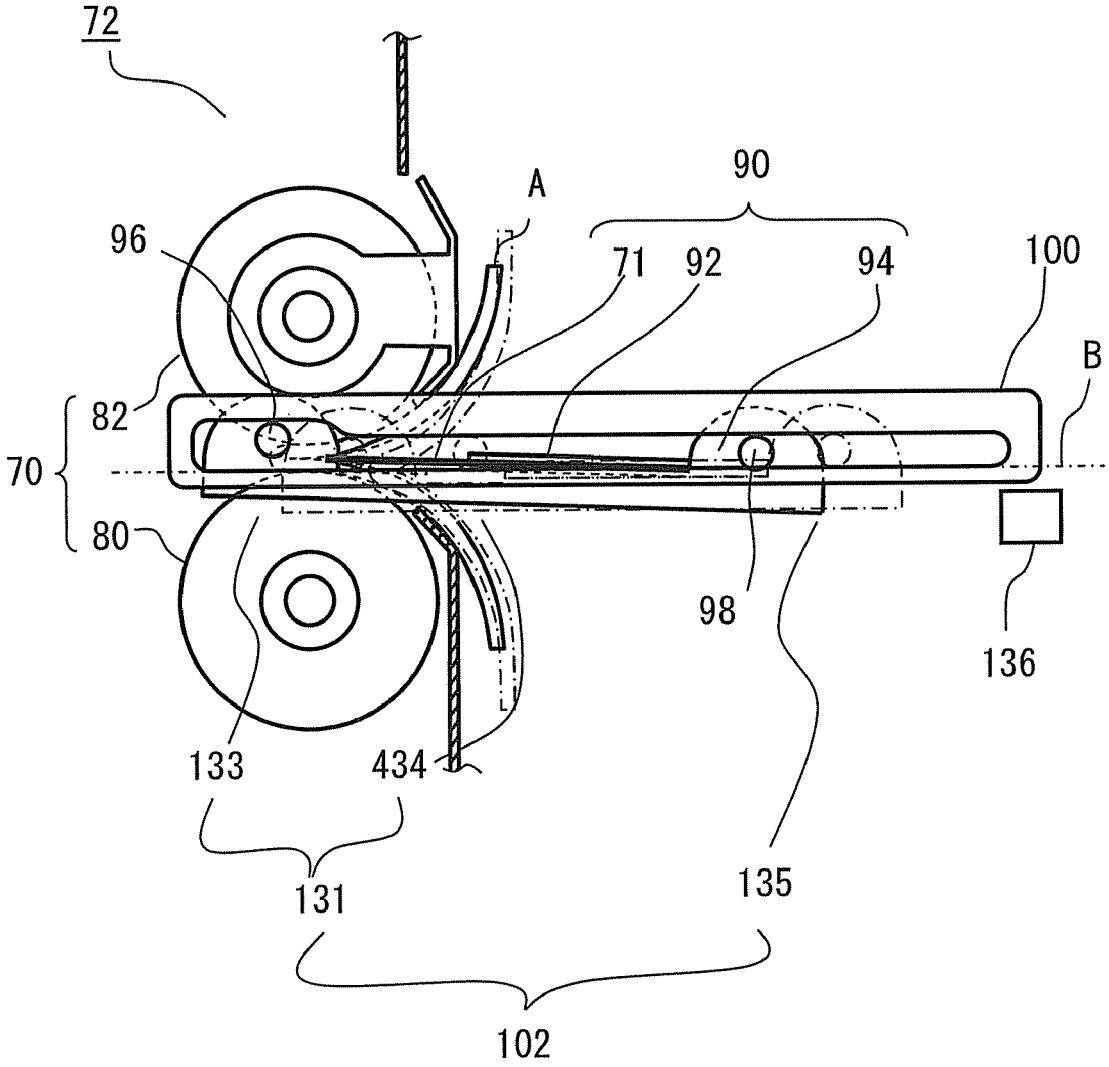
FIG. 30 is a diagram illustrating a cross sectional view of an eighth exemplary instance of a sheet folding unit before a blade approaches into a nip between a folding roller pair but after a sheet stack contacts a folding roller pair.

FIG. 30 illustrates a cross sectional view of the sheet folding unit 72 after the folding roller pair 70 nips the sheet stack A. The nip of the folding roller pair 70 turns into a gap because the sheet stack A pries up the upper folding roller 82 to about twice the thickness of the sheet stack A. The roller cover 130 goes up together with the upper folding roller 82. A relationship between the guide board 132 and the upper folding roller 82 is kept for guiding the sheet stack A to the gap accurately and smoothly, regardless of a thickness of the sheet stack A. After the folding roller pair 70 nips the sheet stack A stably, the blade unit 90 starts to back off, and the folding roller pair 70 discharges the sheet stack A with its folded edge in the lead. The upper folding roller 82 comes down to make the nip with the lower folding roller 80, and the roller cover 130 comes down together with the upper folding roller 82 to recover its position to guide the sheet stack A before the folding roller pair 70 nip the sheet stack A.

Although the invention is shown and described with respect to certain illustrated aspects, it will be appreciated that equivalent alterations and modifications will occur to others skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet folding apparatus, comprising:

a stacker configured to stack a plurality of sheets;

a first folding roller configured to rotate around a first axis;

a second folding roller configured to rotate around a second axis which is in parallel with the first axis and biased to the first folding roller separably to make a nip together with the first folding roller therebetween;

a blade unit configured to push a surface of the plurality of sheets stacked by the stacker, into the nip;

a first shaft configured to move together with the blade unit to support the blade unit;

a second shaft configured to move together with the blade unit to support the blade unit;

a first slot configured to support the first shaft and configured to guide linearly in a common tangential direction of the first folding roller and the second folding roller at the nip; and a second slot comprising a first distance section and a second distance section broader than the first distance section, configured to support the second shaft linearly movable along the common tangential direction in the first distance section when the blade unit passes an entrance section between where the blade unit starts touching at the plurality of sheets and where the plurality of sheets approaches the nip, and configured to deviate the second shaft away to the second folding roller side from a direction parallel to the common tangential line with blocking deviating the second shaft away to a first folding roller side from the direction parallel to the common tangential line in the second distance section when the plurality of sheets approaches the nip.

2. The apparatus of claim 1, wherein the first distance section extended linearly to guide the second shaft to block the blade unit deviating away to the first folding roller side from the direction parallel to the common tangential line; and the second distance section extended in parallel with the first distance section in a stage where the second shaft faces to when the blade unit passes through the entrance section.

3. The apparatus of claim 2, wherein the first slot is in front of the second slot in the common tangential direction, the first folding roller is at a lower side of the second folding roller, the first distance section is at a lower side of the second shaft, and the second guide distance section is at an upper side of the second shaft.

4. The apparatus of claim 2, wherein the first slot is in a rear of the second slot in the common tangential direction, the first folding roller is at a higher side of the second folding roller, the first distance section is at a lower side of the second shaft, and the second distance section is at an upper side of the second shaft.

5. The apparatus of claim 1, wherein the first distance section extended linearly to guide the second shaft to block the blade unit deviating away to the first folding roller side from the direction parallel to the common tangential line; and the second distance section extended in parallel with the first distance section in a first stage where the second shaft faces to when the blade unit passes the entrance section through, and bent to broaden a distance from the first distance section to connect continuously with a second stage where the second shaft faces to when at least one of the plurality of sheets approach the nip.

6. The apparatus of claim 1, wherein the first slot includes a first distance section configured to guide the first shaft linearly, and the second slot includes a second distance section extended linearly from the first guide to guide the second shaft to block the second shaft deviating away to the first folding roller side from the direction parallel to the common tangential line.

7. The apparatus of claim 1, wherein a second shaft is equal to the first shaft in diameter, the first slot includes:

a first distance section extended linearly in parallel with the common tangential direction; and a second distance section extended in parallel with the first distance section;

the first shaft to move linearly along the first distance section and the second distance section, and the second slot includes:

a third distance section extended linearly from the first distance section to guide the second shaft to block the blade unit deviating away to the first folding roller side from the direction parallel to the common tangential line; and a fourth distance section extended from the second distance section linearly in a first stage where the second shaft faces to when the blade unit passes the entrance section through, and bent to broaden a distance from the third distance section to connect continuously with a second stage where the second shaft faces to when the sheet approaches the nip.

8. The apparatus of claim 1, wherein the first slot is in front of the second slot in the common tangential direction.

9. The apparatus of claim 1, wherein the first slot is in a rear of the second slot in the common tangential direction.

10. The apparatus of claim 1, wherein the second shaft is bigger than the first shaft in diameter, the first slot includes a first distance section configured to guide the shaft linearly, and the second slot includes a second distance section extended linearly from the first distance section to guide the second shaft to block the blade unit deviating away to the first folding roller side from the direction parallel to the common tangential line.

11. The apparatus of claim 1, wherein the second slot includes:

a first distance section extended linearly to guide the shaft to block the blade unit deviating away to the first folding roller side from the direction parallel to the common tangential line; and a second distance section extended in parallel with the first distance section in a first stage where the second shaft faces to when the second shaft passes therewith, and terminated to release the shaft when the sheet approaches the nip.

12. The apparatus of claim 1, wherein the second slot, formed independently from the first slot, configured to guide the second shaft linearly when the second shaft passes therewith and configured to fit the second shaft therein with a clearance to deviate the blade unit away to the second folding roller side from the direction parallel to the common tangential line with blocking the blade unit deviating away to the first folding roller side from the direction parallel to the common tangential line when the sheet approaches the nip.

13. The apparatus of claim 12, wherein the first shaft and the second shaft are not in a line in parallel with the common tangential direction, and the first slot and the second slot are not in a line in parallel with the common tangential direction.

* * * * *